US009693591B1

(12) United States Patent
Charnecky

(10) Patent No.: US 9,693,591 B1
(45) Date of Patent: Jul. 4, 2017

(54) WEAR-REDUCING ANCHOR POINT FOR A BRA SUPPORT UNDERWIRE

(71) Applicant: Ronald Steven Charnecky, Hewitt, NJ (US)

(72) Inventor: Ronald Steven Charnecky, Hewitt, NJ (US)

( * ) Notice: Subject to any disclaimer, the term of this patent is extended or adjusted under 35 U.S.C. 154(b) by 0 days.

(21) Appl. No.: 15/426,013

(22) Filed: Feb. 6, 2017

Related U.S. Application Data

(63) Continuation of application No. PCT/US2016/055982, filed on Oct. 7, 2016.

(60) Provisional application No. 62/363,582, filed on Jul. 18, 2016.

(51) Int. Cl.
*A41C 3/00* (2006.01)
*A41C 3/12* (2006.01)

(52) U.S. Cl.
CPC ..... *A41C 3/126* (2013.01)

(58) Field of Classification Search
CPC .. A41C 1/20; A41C 1/14; A41C 3/007; A41C 3/128; A41C 3/126; A41C 3/122; A41C 3/12
USPC ..... 2/257, 255, 258, 259, 260.1, 260, 264, 2/263; 450/41, 45, 47, 51, 52
See application file for complete search history.

(56) References Cited

U.S. PATENT DOCUMENTS

| | | | | |
|---|---|---|---|---|
| 3,799,178 | A * | 3/1974 | Anderson | B28B 7/386 118/321 |
| 6,152,802 | A * | 11/2000 | Horta | A41C 3/126 450/48 |
| 6,780,080 | B2 * | 8/2004 | Horta | A41C 3/126 2/259 |
| 7,850,507 | B2 * | 12/2010 | Horta | A41C 3/126 450/41 |
| 2008/0057829 | A1 * | 3/2008 | Littell | A41C 3/12 450/41 |
| 2010/0242157 | A1 * | 9/2010 | Littell | A41C 3/12 2/257 |

* cited by examiner

*Primary Examiner* — Gloria Hale
(74) *Attorney, Agent, or Firm* — FisherBroyles, LLP; Edward Ergenzinger

(57) ABSTRACT

The invention is an anchor point device for use with a bra support underwire comprising: a unitary interface sleeve comprising a distal paraboloid section with an underwire cavity passing therethrough; a cylindrical section extending from the distal paraboloid section, the cylindrical section having the underwire cavity terminating therein; a proximal paraboloid section extending from the cylindrical section; and an anchor tab, configured as a geometric shape, a threaded component, a ribbed component, or a reinforced thread, attached to the interface sleeve. The invention provides reduced kinetic friction and kinetic wear between support underwires and ultra thin tubular fabric casings.

28 Claims, 23 Drawing Sheets

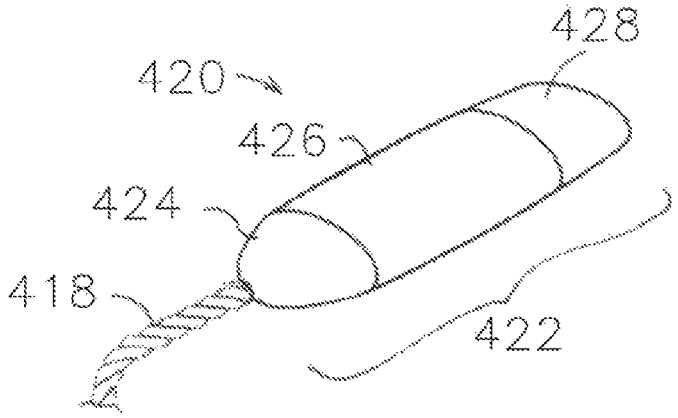
Fig. 41
Fig. 42
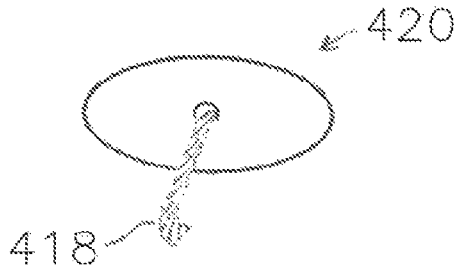
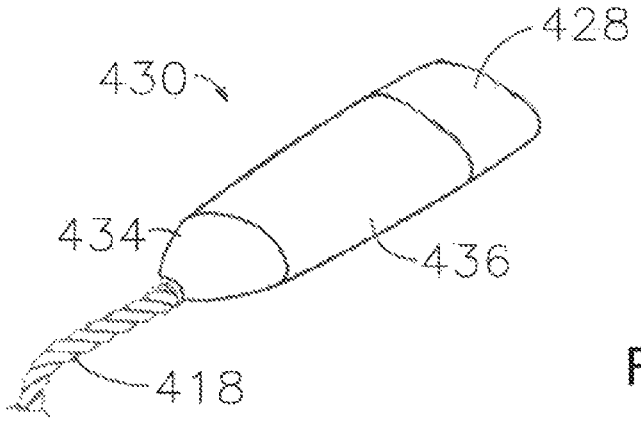
Fig. 43

WEAR-REDUCING ANCHOR POINT FOR A BRA SUPPORT UNDERWIRE

CROSS-REFERENCE TO RELATED APPLICATIONS

The presently disclosed subject matter is related to U.S. Provisional Patent App. No. 62/363,582, entitled "WEAR-REDUCING ANCHOR POINT FOR A BRA SUPPORT UNDERWIRE," filed on Jul. 18, 2016; and PCT International Patent App. No. PCT/US2016/055982, entitled "WEAR-REDUCING ANCHOR POINT FOR A BRA SUPPORT UNDERWIRE," filed on Oct. 7, 2016, the entire disclosures of which are incorporated herein by reference.

FIELD OF THE INVENTION

The present invention relates to a system and method for preventing or repairing damage caused by the protrusion of a cup support underwire from a bra.

BACKGROUND OF THE INVENTION

Conventional support bra underwire designs incorporate an underwire support ("underwire"), which is typically made of a narrow steel band, wire, coated metal or a customized plastic support component. The support underwire is commonly retained within a molded or sewn, ultra thin tubular fabric casing or pocket located under a cup of the bra. It has been known in the art for some years that the end of the support underwire is abrasive and wears against the inside of the ultra thin tubular fabric casing whenever the bra is handled or worn.

This results from conventional fabrication designs where the internal length of the ultra thin tubular fabric casing is greater than the length of the enclosed underwire. This configuration allows the underwire to move around, or "float," inside the ultra thin tubular fabric casing, often by as much as one inch in either direction. As the end of the underwire can be very abrasive against the interior surface of the ultra thin tubular fabric casing, this one-inch floating usually produces a "wear gap" at one or both ends of the material forming the ultra thin tubular fabric casing.

Movement of the underwire within the ultra thin tubular fabric casing may be caused by: normal usage of the bra; by flexing; by washing, drying, and hanging of the bra; by folding and packing of the bra; and even by simple every day activities. The abrasive end of the support underwire constantly stresses against the ultra thin tubular fabric casing, causing wear and eventually penetrates the material.

While the consumer can often repair a broken bra strap or a bent hook, the problem of the protruding underwire support can be only temporarily repaired, if at all. When this damage occurs in a relatively expensive retail or custom designed bra the user most frequently just reinstalls the support underwire back inside the bra ultra thin tubular fabric casing and may attempt to cover over the torn area, such as exemplified by U.S. Pat. No. 8,778,475 to Joyce et al. Such temporary repairs do not last long, where the wearer is eventually again subjected to being at the very least constantly uncomfortable by being scratched by the re-exposed support underwire or in some cases, the wearer of the bra may be in pain due to being pierced on the lateral side of her body by the exposed abrasive end of the underwire.

A temporary "fix" often employs tape or glue to the damaged area. Using a cloth tape provides an interim repair, which eventually succumbs to failure due to laundry agitation, chemicals, or piercing again by the support underwire. Iron-on patches of tape using a heat activated glue, where the material may be stronger than the original softer ultra thin tubular fabric casing is only a delaying tactic, only to result once again in the piercing of the ultra thin tubular fabric casing. The actual issue of friction/penetration has not been adequately addressed in the present state of the art.

Conventional fabrication solutions to prevent such wear gaps include the addition of an extremely thin rubber coating over some steel underwires, or a rounding of the ends of abrasive plastic underwires. U.S. Pat. No. 3,562,802 "Wire frames for bras and the like" ofAvis discloses smooth metal caps and plastics material used on the ends of the underwire. U.S. Pat. No. 7,666,060 "Safety bra support" of Cheung discloses a thermally contractible case attached to the tip of an underwire. U.S. Pat. No. 9,017,137 "Pre-encased underwire assembly" of Boser discloses an underwire that is fully enclosed in a fabric enclosure as a separate assembly.

UK Patent Application GB 2458675 discloses an insert using reverse angled barbs ("textured outer surface"). These barbs were intended to hold the insert in place within the sewn sleeve. But this idea was seriously flawed as the barbs themselves become multiple wear points, and still do not address an anchoring of the underwire with a serious reduction in kinetic friction. U.S. Pat. No. 8,464,401 "Support device" of Littell discloses a base and surrounding sidewall with flanges used as a repair device to prevent the re-emergence of the abrasive underwire resulting from wear of the ultra thin tubular fabric casing. However, the Littell device lacks the ability for installation within the ultra thin tubular fabric casing. Moreover, the particular design taught by Littell presents abrasive surfaces to the bra ultra thin tubular fabric casing, and is not configured to repair a bra having an exposed underwire.

The temporary fix of using an adhesive "glue" to bridge over the wear gap of the underwire providing perhaps a few hours to a day of wear or so but the abrasive steel or other abrasive underwire material is relentless in its stress against the same location within the ultra thin tubular fabric casing and will breach shortly thereafter.

The issue of the primarily used unanchored abrasive steel underwire support, or the lesser-used unanchored abrasive plastic underwire support, provides to the public an inferior costly product which will at some point provide discomfort and pain due to being scratched or worse having the skin penetrated by the underwire causing the wearer to have an open wound and eventually skin discoloration once a wound is healed. The "support underwire" floating in the ultra thin tubular fabric casing causes the "wear gap" damage. This process of damage to the bra ultra thin tubular fabric casing actually begins once the underwire has been inserted at the factory. It is known in the art that the support underwire can begin to wear through the ultra thin tubular fabric casing from the time the bra is first packaged at the factory. There is no known design that addresses the issues described above. What is needed is a method and device to cure these shortcomings.

BRIEF SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

In one aspect of the present invention, a wear-reducing anchor point device for use with a bra support underwire comprises: an interface sleeve having a continuously smooth outer surface, the interface sleeve further having an enclosed underwire cavity sized and shaped to accommodate an end of the bra support underwire; and an anchor tab attached to the interface sleeve.

In another aspect of the present invention, an wear-reducing anchor point device for use with a bra support underwire comprises: a unitary interface sleeve comprising a distal paraboloid section with an underwire cavity passing therethrough; a cylindrical section extending from the distal paraboloid section, the cylindrical section having the underwire cavity terminating therein; a proximal paraboloid section extending from the cylindrical section; and an anchor tab attached to the interface sleeve.

In another aspect of the present invention, an underwire assembly for use as a bra support comprises: a support underwire; a first unitary interface sleeve emplaced on a first end of the support underwire, the first unitary interface sleeve comprising a first distal paraboloid section with a first underwire cavity passing therethrough; a first cylindrical section extending from the first distal paraboloid section, the first cylindrical section having the first underwire cavity terminating therein; a first proximal paraboloid section extending from the first cylindrical section; and an anchor tab attached to the interface sleeve.

In another aspect of the present invention, a wear-reducing anchor point device comprises; a full length arcuate tubular interface support body, a hollow distal paraboloid apex, a hollow proximal paraboloid apex, a distal reinforced thread anchor, a proximal reinforced thread anchor; the distal reinforced thread anchor passes therethrough the distal paraboloid apex aperture for anchoring, the proximal reinforced thread anchor passes therethrough the proximal paraboloid apex aperture for anchoring.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTIONS OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

FIG. 41 is an isometric diagrammatical view of a reinforced thread wear-reducing anchor point body having an interface sleeve with an attached reinforced thread for anchoring, in accordance with the present invention;

FIG. 42 is a rear diagrammatical view of the reinforced thread wear-reducing anchor point body of FIG. 41;

FIG. 43 is an isometric diagrammatical view of an alternative reinforced thread wear-reducing anchor point body having a tapered interface sleeve with the reinforced thread;

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention. The present invention results from observations that a wear-reducing anchored interface should be provided so as to mitigate the abrasive effects from the end of an unanchored underwire to the bra ultra thin tubular fabric casing material. Although the examples provided herein are described in the context of a bra ("brassiere") support underwire, those of skill in the art will understand that the invention can be incorporated for use within any garment that comprises a support underwire, including but not limited to lingerie, camisoles, corsets, swimsuits, shirts, tops, dresses, and the like.

The present invention is a wear-reducing anchor point (WRAP) device that eliminates the problem of premature under cup ultra thin tubular fabric casing wear in an underwire bra. The disclosed WRAP device includes: (i) a cylindrical underwire cavity to provide the wear-reducing interface by enclosing an end of the underwire, and (ii) a smooth enclosure overlying the underwire cavity to provide the low-friction surface interface; (iii) coupled with multiple options to secure an interface to the bra, as described below.

Figure 1:
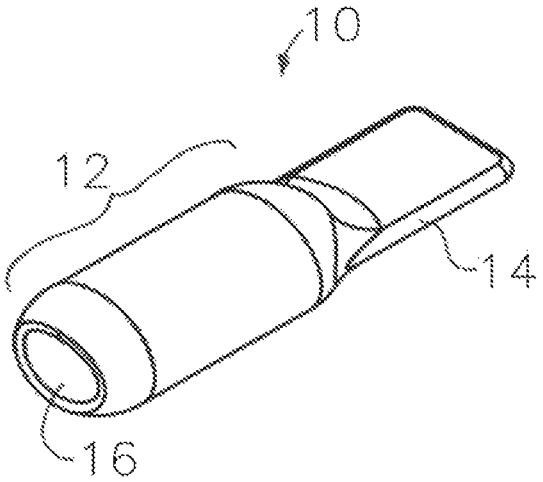
FIG. 1 is an isometric diagrammatical illustration of an wear-reducing anchor point body having an interface sleeve and an anchor tab, in accordance with the present invention.

There is shown in FIG. 1 a WRAP device configured as a wear-reducing anchor point body 10 comprising of an interface sleeve 12 and an attached anchor tab 14. The interface sleeve 12 is preferably made from a plastic material, and includes an underwire cavity 16, in accordance with an exemplary embodiment of the present invention. The interface sleeve 12 can be fabricated by a molding process using a polymer, a perforated polymer, rubber, silicone or combination of polymers, rubber, silicone, synthetic, such as for example, nylon, as well-known in the relevant art. Other fabrication methods can also be used comprising, for example, extrusion or 3-D printing, as is well known in the relevant art. The wear-reducing anchor point body 10 is configured to fit onto a bra support underwire 28, shown in FIG. 2, so as to prevent wear on the interior of an ultra thin tubular fabric casing (not shown) from a free end of the support underwire 28. In particular, the underwire cavity 16 is sized and shaped so as to accommodate the end of the support underwire 28.

Figure 2:
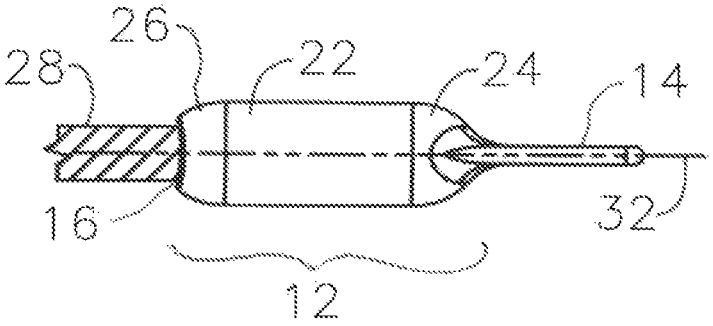
FIG. 2 is a side view of the wear-reducing anchor point body of FIG. 1.
Figure 3:
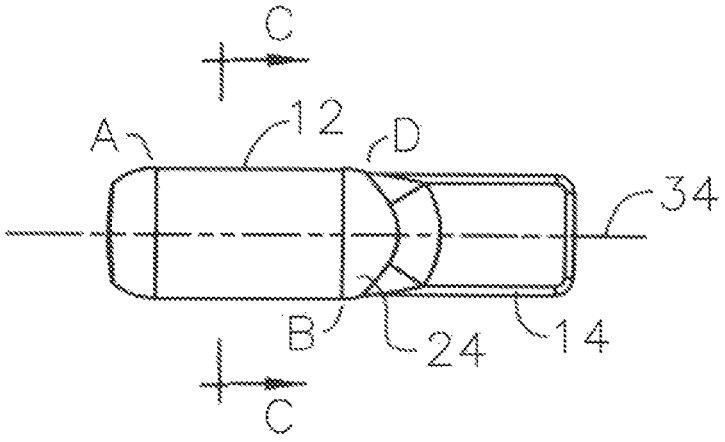
FIG. 3 is a top view of the wear-reducing anchor point body of FIG. 1.

As can be seen in the side view of FIG. 2 and in the top view of FIG. 3, the interface sleeve 12 is generally configured as unitary component having: (i) a central cylindrical section 22, (ii) a proximal paraboloid section 24, proximate the anchor tab 14, and extending from a first end of the cylindrical section 22, and (iii) a distal paraboloid section 26 extending from a second end of the cylindrical section 22. The curved outer surfaces of the distal paraboloid section 26, the cylindrical section 22, and the proximal paraboloid section 24 form a smooth, continuous surface that provides the low-friction interface between the interface sleeve 12 and the interior surface of the ultra thin tubular fabric casing. The wear-reducing anchor point body 10 is generally symmetrical about a side axis of symmetry 32, and about a top axis of symmetry 34.

It should be noted that there is a first smooth transition from the surface of the distal paraboloid section 26 to the surface of the cylindrical section 22, indicated as region 'a,' and a second smooth transition from the surface of the cylindrical section 22 to the surface of the proximal paraboloid section 24, indicated as region 'b.' Preferably, there is also a smooth transition between the anchor tab 14 and the attached proximal paraboloid section 24, indicated as region 'd.' These smooth transitions serve to minimize or eliminate any friction or mechanical engagement between the anchor point body 10 and the interior surface of the ultra thin tubular fabric casing. In an exemplary embodiment, the anchor tab 14 comprises a solid geometric shape having rounded edges and corners to minimize or eliminate wear of surrounding material. See, for example, mesh anchor tab 50, side-mounted anchor tab 92, T-shaped anchor tab 130, and anchor tab 230 below.

Figure 4:
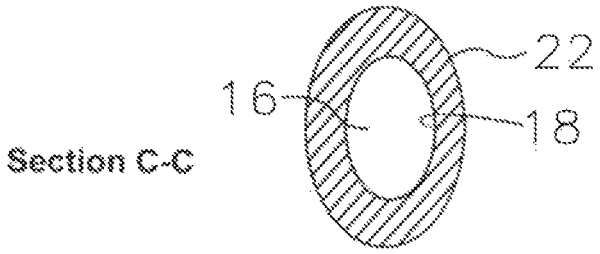
FIG. 4 is a cross-sectional diagrammatical view of the elliptical wear-reducing anchor point body of FIG. 3 showing a support underwire cavity having an elliptical opening.

The cylindrical section 22 may have an elliptical cross section, as shown in section C-C of FIG. 4. It can be seen that the underwire cavity 16 may have an internal elliptical surface 18, or may alternatively have an internal circular shape or an internal oval shape, as exemplified by the examples in FIGS. 22 and 23 below. The proximal paraboloid section 24 and the distal paraboloid section 26 may each have a similar elliptical cross-sectional shape, an oval cross-sectional shape, a circular cross-sectional shape (not shown), or one of a plurality of smooth curved shapes. That is, the interface sleeve 12 may comprise any combination of circular and/or elliptical and/or smooth curved cross sectional shapes in the three sections 22, 24, and 26.

The smooth transition surface characteristics described above insure that there will be no binding, and essentially no friction, between the interface sleeve 12 and the interior of the ultra thin tubular fabric casing. Consequently, little, if any, wear should result in the ultra thin tubular fabric casing during normal use of the bra with the disclosed WRAP configurations. The outer surfaces of the distal paraboloid section 26 and the proximal paraboloid section 24 may thus either or both form elliptic paraboloid surfaces, or may comprise circular paraboloid surfaces.

In the configuration shown in FIG. 3, the anchor tab 14 is attached to and extends from the proximal paraboloid section 24 of the interface sleeve 12. The anchor tab 14 may be a flexible material, a semi-flexible material, a semi-rigid material, a rigid component comprising a solid material, flexible synthetic material, solid synthetic material or a fabric material that can be attached to the proximal paraboloid section 24 after the interface sleeve 12 has been formed. This attachment of the anchor tab 14 to the interface sleeve 12 may be accomplished by molding or using chemical means such as, for example, an epoxy or by use of frequency welding. It can be appreciated by one skilled in the art that the anchor tab 14 can be used in the process of repairing underwire damage to an ultra thin tubular fabric casing, by securing the anchor tab 14 to the bra by using sewing or another mechanical method, so as to keep the interface sleeve 12 from moving inside the ultra thin tubular fabric casing. Alternatively, the anchor tab 14 may be fabricated as part of the material forming the interface sleeve 12, when the interface sleeve 12 is being fabricated, as is well known in the relevant art.

Using the support underwire cavity 16 with an elliptical opening in the cylindrical section 22, as shown in FIG. 4, may be the preferred configuration to accommodate the end or tip of a support underwire having a generally conforming elliptical cross-sectional shape. The inside surface 18 of the underwire cavity 16 may provide a bearing surface against which the friction causing end of a support underwire may slide. It should be understood that, as commercially-produced abrasive support underwire ends may have various cross-sectional shapes comprising, for example, rectangular or oval, the cross sectional shape of an underwire cavity can be appropriately sized and shaped to accommodate a particular support underwire design.

Figure 5:
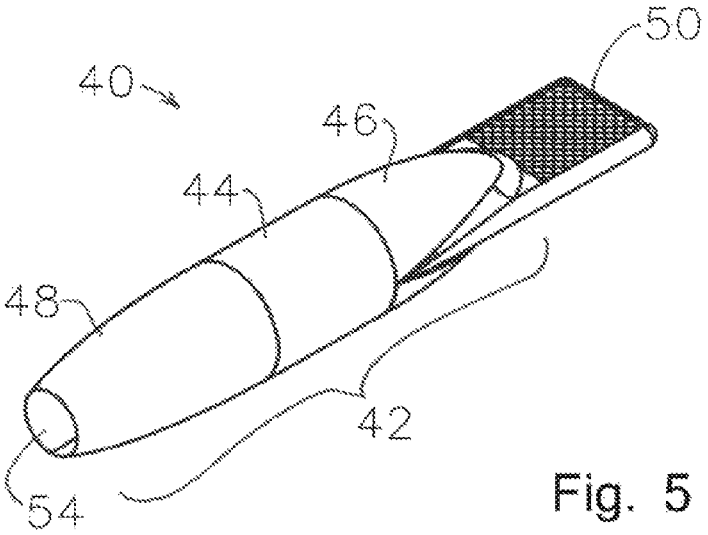
FIG. 5 is an isometric diagrammatical illustration of an wear-reducing anchor point body having an interface sleeve and a mesh anchor tab, in accordance with the present invention.

There is shown in FIG. 5 a WRAP device configured as a wear-reducing anchor point body 40 comprising an interface sleeve 42 with a circular cross section, and an attached mesh anchor tab 50. The interface sleeve 42 is generally configured as unitary component having a central cylindrical section 44, a proximal paraboloid section 46, proximate the anchor tab 50 and extending from a first end of the cylindrical section 44, and a distal paraboloid section 48 extending from a second end of the cylindrical section 44. It should be noted that the proximal paraboloid section 46 and the distal paraboloid section 48 similarly have circular cross sections. An underwire cavity 54 is provided in the distal paraboloid section 48 and extends into the cylindrical section 44. The mesh anchor tab 50 may be a flexible material, a semi-flexible material, a semi-rigid material, a rigid component comprising a solid material, or a fabric material. The mesh anchor tab 50 may be attached to the proximal paraboloid section 46 after the interface sleeve 42 has been formed, by frequency welding or the use of chemical means such as, for example, an epoxy.

Figure 6:
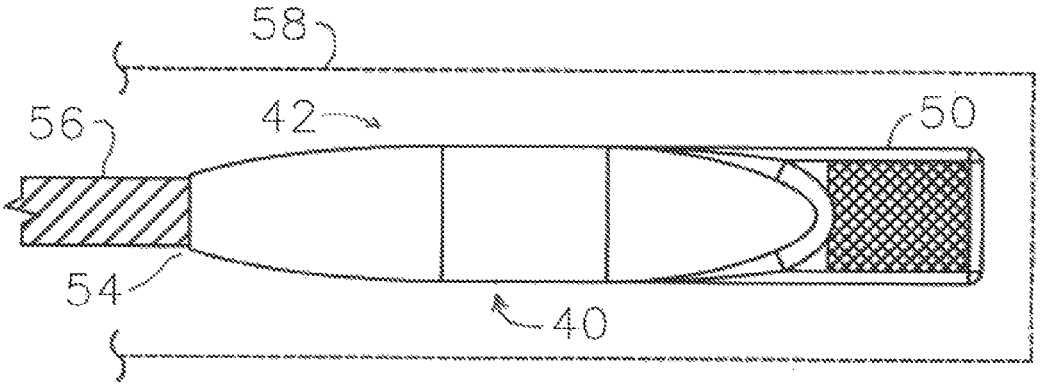
FIG. 6 is a top view of the wear-reducing anchor point body of FIG. 5 enclosed in an ultra thin tubular fabric casing.

As shown in FIG. 6, the wear-reducing anchor point body 40 can be emplaced within an ultra thin tubular fabric casing 58 so as to protect the ultra thin tubular fabric casing 58 from damage caused by a friction producing support underwire 56. This emplacement normally occurs when a repair is being made to the ultra thin tubular fabric casing 58. Part of a seam in the ultra thin tubular fabric casing 58 may be opened to allow the interface sleeve 42 to be inserted into the ultra thin tubular fabric casing 58, with the support underwire cavity 54 placed over an abrasive end of the support underwire 56, substantially as shown. The ultra thin tubular fabric casing 58 can then be reclosed, such as by sewing.

For clarity of illustration, the ultra thin tubular fabric casing 58 is shown as being dimensionally wider than the interface sleeve 42, but it should be understood that the width, or diameter, of the interface sleeve 42 is appropriately sized for conforming or "snug" insertion into the ultra thin tubular fabric casing 58. The mesh anchor tab 50 can be secured to the bra by means of stitching, or otherwise affixing inside the ultra thin tubular fabric casing 58 (not shown for clarity of illustration), thus restricting further movement of the wear-reducing anchor point body 40. It should be understood that the wear-reducing anchor point body 40 can be positioned anywhere within the ultra thin tubular fabric casing 58 that provides protection of the ultra thin tubular fabric casing 58 from the abrasive end of the support underwire 56.

Figure 7:
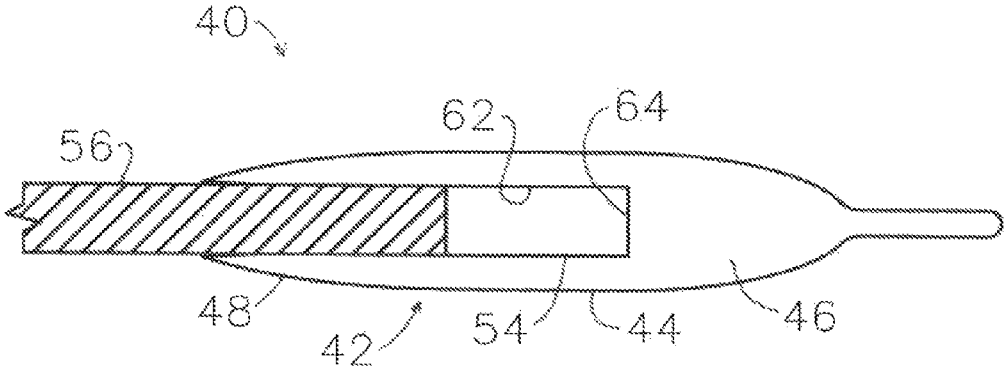
FIG. 7 is a cross-sectional side view of the wear-reducing anchor point body of FIG. 5 showing placement of a support underwire.

As shown in the side cross-sectional view of the anchor point body 40, in FIG. 7, the underwire cavity 54 extends through the distal paraboloid section 48 and into the cylindrical section 44 of the interface sleeve 42 a specified distance, and may even extend into the proximal paraboloid section 46. The specified distance is sufficient to allow the support underwire 56 to extend into the underwire cavity 54 for at least a minimum retention distance when the wear-reducing anchor point body 40 is optimally positioned and secured within the ultra thin tubular fabric casing 58, shown in FIG. 6.

When the wear-reducing anchor point body 40 is thus optimally positioned within the ultra thin tubular fabric casing 58, the movement of the abrasive end of the support underwire 56 along an inside surface 62 of the underwire cavity 54 in the wear-reducing anchor point body 40 may vary from between the minimum retention distance up to possible intermittent contact with a closed end 64 of the underwire cavity 54. The support underwire 56 is thus positively retained within the wear-reducing anchor point body 40, and is thus prevented from slipping out of the underwire cavity 54, even during the above-described wearing and handling of the bra. A similar configuration may be used with the support underwire 28 in the underwire cavity 16 of FIG. 2.

Figure 8:
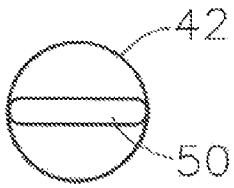
FIG. 8 is a rear view of the wear-reducing anchor point body of FIG. 5 showing the mesh anchor tab.
Figure 9:
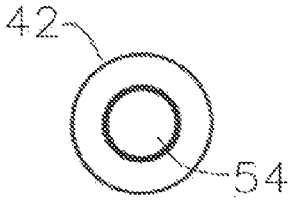
FIG. 9 is a front view of the wear-reducing anchor point body of FIG. 5 showing the support underwire cavity.
Figure 10:
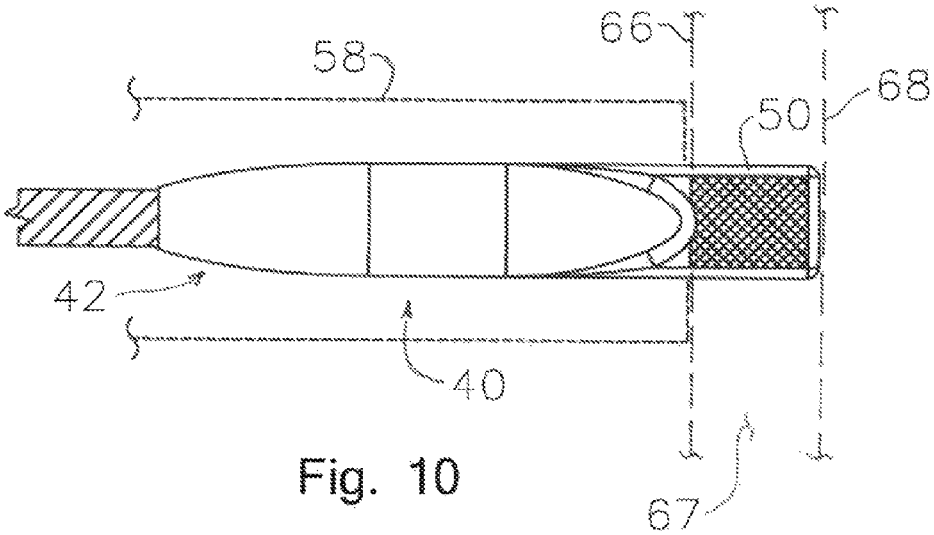
FIG. 10 is a top view of the wear-reducing anchor point body of FIG. 5 as secured at a bra hemline.

FIG. 8 illustrates that the width of the mesh anchor tab 50 is about the same as the diameter of the interface sleeve 42. FIG. 9 shows that the underwire cavity 54 is substantially centered in the interface sleeve 42. In an alternative embodiment, shown in FIG. 10, the mesh anchor tab 50 can be positioned such that the stitching through the mesh anchor tab 50 is part of an inner underarm cup hem edge 66 of a bra 410, shown in FIG. 40. In the bra 410, an underarm cup hem 67 is shown between the inner underarm cup hem edge 66 and an outer underarm cup hem edge 68. The mesh anchor tab 50 may or may not also pass through the outer cup hem edge 68 depending on the manufacturing or repair technique used. The interface sleeve 42 part of the anchor point body 40 is retained in the ultra thin tubular fabric casing 58, as shown in FIG. 10.

Figure 11:
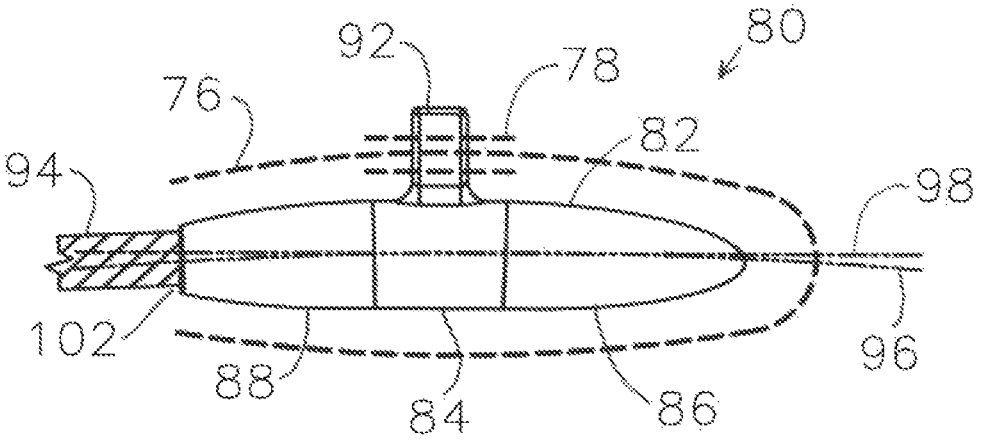
FIG. 11 is a side diagrammatical view of an arcuate wear-reducing anchor point body showing a side mounted anchor tab secured in an ultra thin tubular fabric casing, in accordance with the present invention.

As most ultra thin tubular fabric casings are somewhat arcuate, and follow the contour of the underside of a wearer's breast, an alternative WRAP device configuration is an arcuate wear-reducing anchor point body 80 that may be used with a arcuate underwire 94, if desired, as shown in FIG. 11. Note that the arcuate wear-reducing anchor point body 80 generally follows an arcuate side axis 96, in comparison to a straight side axis 98 that corresponds to a straight anchor point body, such as the wear-reducing anchor point body 10 shown in FIG. 2.

Referring again to FIG. 11, the arcuate wear-reducing anchor point body 80 comprises an arcuate interface sleeve 82 with a side-mounted, wear-reducing, anchor tab 92. The arcuate interface sleeve 82 includes a proximal paraboloid section 86 and a distal paraboloid section 88, both attached to an arcuate cylindrical section 84. Securing the arcuate wear-reducing anchor point body 80 within an arcuate ultra thin tubular fabric casing 76 may be accomplished by stitching 78 through the side mounted anchor tab 92, as shown. Alternatively, the side mounted anchor tab 92 may be secured by using another mechanical attachment method (not shown), such as the insertion of rivets in place of the stitching 78. Or, an adhesive or other chemical compound such as epoxy, frequency welding or a pressure process may be used on the side mounted anchor tab 92 to secure the arcuate anchor point body 80 within the arcuate ultra thin tubular fabric casing 76. It can be appreciated that, in exemplary embodiments, the side-mounted anchor tab 92 may be used with the interface sleeve 12 (shown in FIG. 1), and that the anchor tab 14 (shown in FIG. 1) may be used with the arcuate interface sleeve 82.

Figure 12:
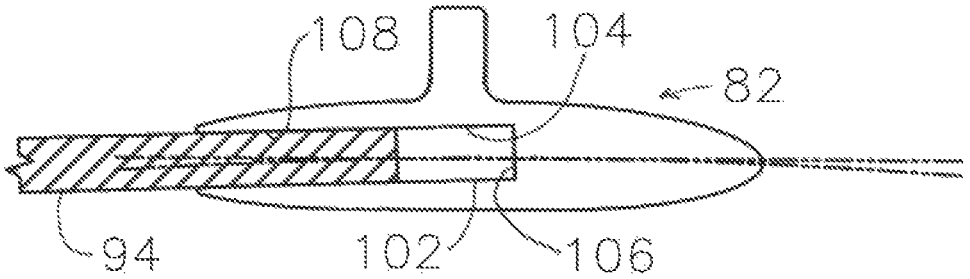
FIG. 12 is a sectional side view of the arcuate anchor point body of FIG. 11 showing insertion of an support underwire in the ultra thin tubular fabric casing.

The arcuate anchor point body 80 may include an arcuate underwire cavity 102 generally conforming to the curvature of the arcuate support underwire 94, as best seen in FIG. 12, which is a sectional view of the arcuate interface sleeve 82. The arcuate underwire cavity 102 includes an arcuate internal surface 104 extending to a closed end 106 in the arcuate interface sleeve 82. There may be an adhesive 108 on the arcuate internal surface 104 to restrict movement of the arcuate support underwire 94 relative to the arcuate internal surface 104. It should be understood that any of the WRAP interface sleeve embodiments disclosed herein may benefit from use of an adhesive inside the respective underwire cavity to secure the interface sleeve to an inserted underwire and to prevent misalignment of the support underwire within the respective interface sleeve.

Figure 13:
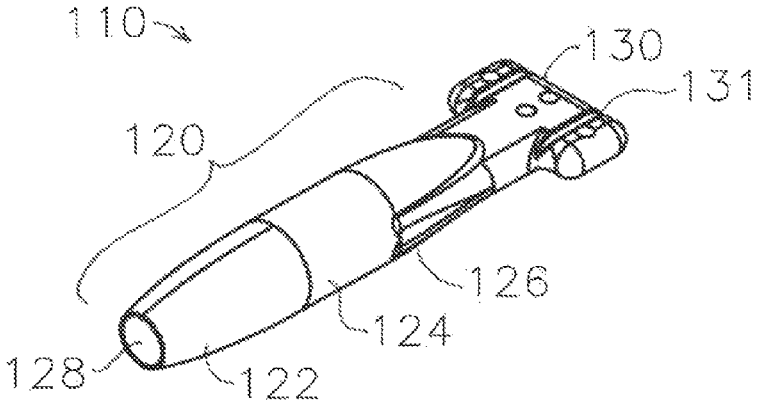
FIG. 13 is an isometric diagrammatical view of a T-tab anchor point body having an interface sleeve with an attached, or a unitary, T-shaped anchor tab, in accordance with the present invention.

Another alternative embodiment of a WRAP device is a T-tab wear-reducing anchor point body 110, shown in FIG. 13, comprising an interface sleeve 120 with an attached, or a unitary, T-shaped anchor tab 130. The interface sleeve 120 includes a distal paraboloid section 122, a cylindrical section 124, and a proximal paraboloid section 126. An underwire cavity 128 extends through the distal paraboloid section 122 and into the cylindrical section 124. The T-shaped anchor tab 130 is configured to more positively retain the interface sleeve 120 within an ultra thin tubular fabric casing (not shown), and the T-shaped anchor tab 130 is configured to be secured in an underarm cup hem 67, (not shown) or neck hem 414 (not shown). In addition, a pattern of fastening holes 132 may be provided in the T-shaped anchor tab 130 to enable optional stitching. In an exemplary embodiment, the T-shaped anchor tab 130 may include one or two grooves 131 that allow a user to break off part of the T-shaped anchor tab 130, if desired.

Figure 14:
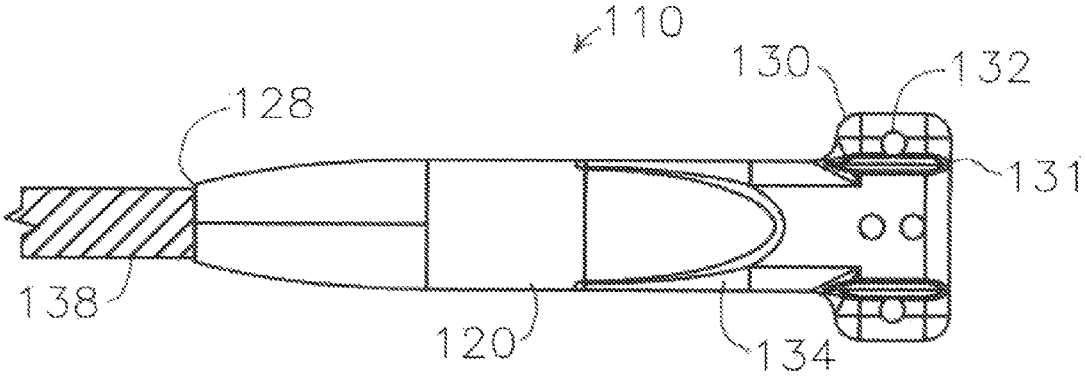
FIG. 14 is a top view of the T-tab wear-reducing anchor point body of FIG. 13 with an inserted support underwire.

As shown in FIG. 14, the underwire cavity 128 is sized and shaped to accommodate a support underwire 138, as described above for underwire cavities 16 and 54. The T-shaped anchor tab 130 includes four through-holes 132 arranged in a cross pattern over the grooves 131. The through-holes can be used to enable securing of the T-tab anchor point body 110 by means of a reinforced thread or filament passing through the through-holes 132 and the bra 410 material, as known in the relevant art. In the particular configuration shown, the T-shaped anchor tab 130 includes tapered fins 134 shaped to provide a smooth transition surface from the T-shaped anchor tab 130 to the interface sleeve 120, as also shown in FIG. 15.

Figure 15:
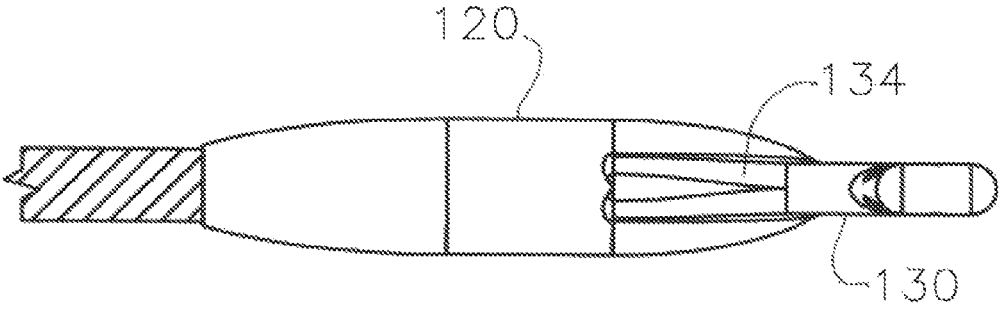
FIG. 15 is a side view of the T-tab wear-reducing anchor point body of FIG. 13.

FIG. 15 is a side view of the T-tab anchor point body of FIG. 13.

Figure 16:
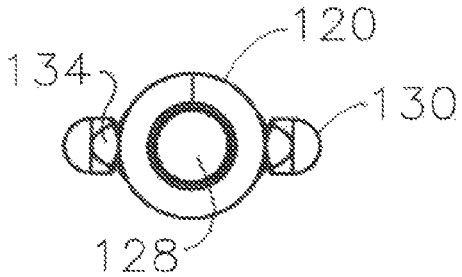
FIG. 16 is a front view of the T-tab wear-reducing anchor point body of FIG. 13 showing the ultra thin tubular fabric casing and the T-tab anchor tab.
Figure 17:
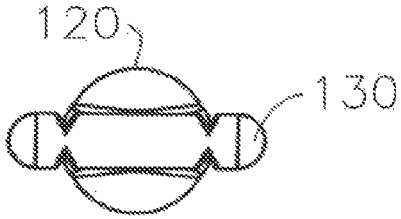
FIG. 17 is a rear view of the T-tab wear-reducing anchor point body of FIG. 13 showing the T-tab anchor tab.

FIG. 16 is a front end view of the T-tab wear-reducing anchor point body 110 showing the T-shaped anchor tab 130 with the tapered fins 134, and the underwire cavity 128 centrally disposed within the interface sleeve 120. FIG. 17 is a back end view of the T-tab wear-reducing anchor point body 110 showing the T-shaped anchor tab 130.

Figure 18:
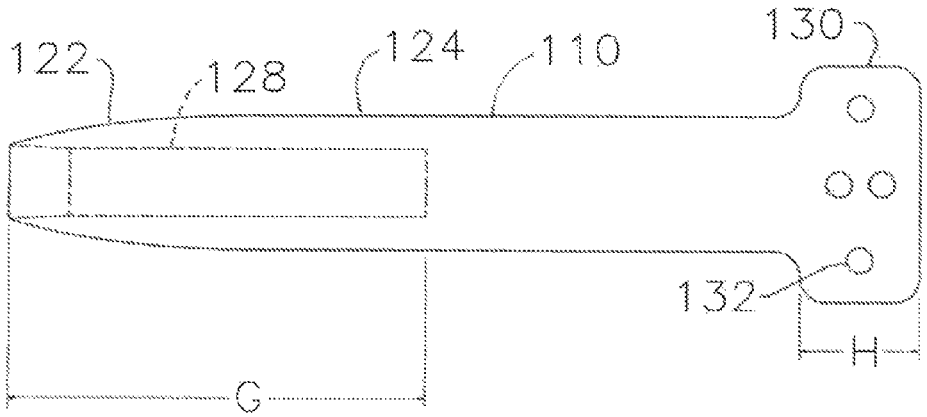
FIG. 18 is a simplified top view of the T-tab wear-reducing anchor point body of FIG. 13 showing an internal support underwire cavity.
Figure 19:
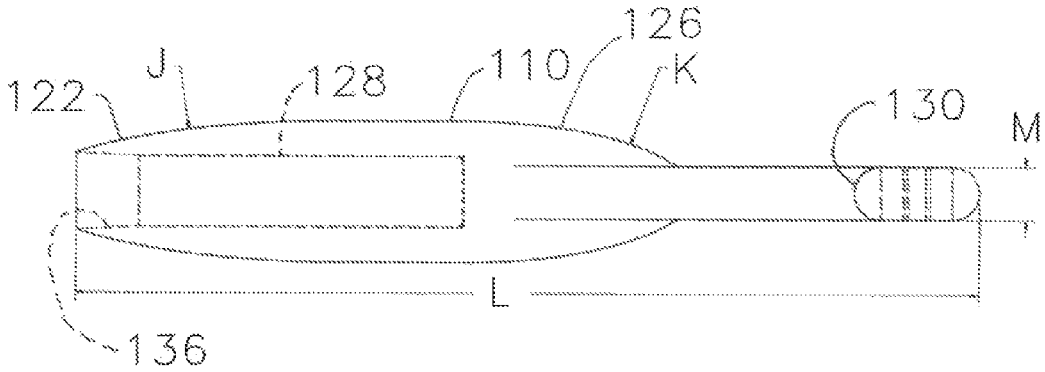
FIG. 19 is a simplified sectional diagrammatical view of the wear-reducing anchor point body of FIG. 13 showing the internal support underwire cavity.

A simplified top view of the wear-reducing anchor point body 110 is shown in FIG. 18. The length 'G' of the underwire cavity 128 may be about 0.375 inches, extending through the distal paraboloid section 122 and into the central cylindrical section 124. The anchor tab 130 may have a width 'H' of about 0.25 inches, and a length of about 0.3125 inches to allow for the pattern of the four anchor point through-holes 132. As shown in FIG. 19, the wear-reducing anchor point body 110 may have an overall length 'L' of about 1.00 inches with an anchor tab 130 thickness 'M' of about 0.0469 inches. The distal paraboloid section 122 may have an outer radius of curvature of about 0.250 inches, and the proximal paraboloid section 126 may have an outer radius of curvature 'K' of about 0.250 inches. The underwire cavity 128 may include a slightly flared or beveled opening end 136 at a surface of the distal paraboloid section 122 to provide for easier insertion of the underwire 138, shown in FIG. 14. It should be noted that this flared or beveled feature can be included in any of the underwire cavities disclosed herein.

Figure 20:
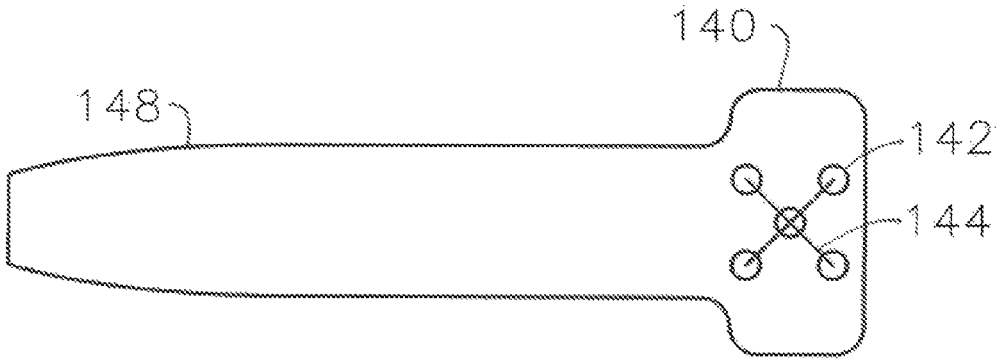
FIG. 20 is a T-shaped anchor tab having a set of five through-holes arranged in a cross-shaped pattern.

FIG. 20 shows a T-shaped anchor tab 140 having a set of five through-holes 142 arranged in a cross-shaped pattern with one of the through holes 142 at the center of the cross-shaped pattern, and four of the through-holes at the ends of the cross-shaped pattern. An interface sleeve 148 is shown only in outline, for clarity of illustration. Stitching 144 used to secure the T-shaped anchor tab 140 may form an X-shaped pattern, as shown.

Figure 21:
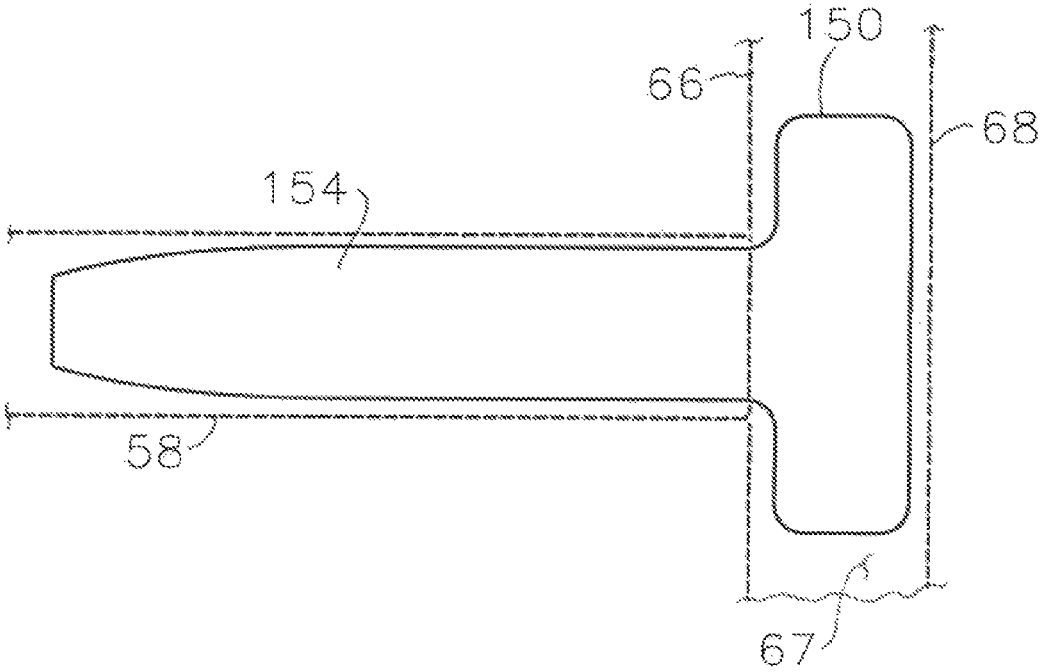
FIG. 21 is a wide T-shaped anchor tab that is configured to be retained in place within a support casing by means of a stitching pattern that encloses the wide T-shaped anchor tab.
Figure 40:
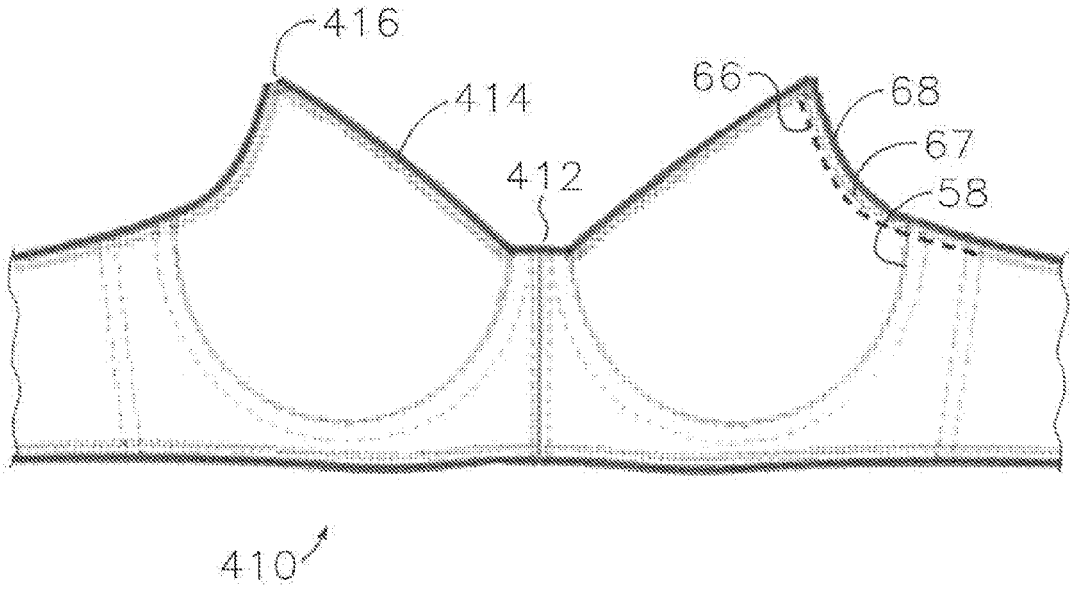
FIG. 40 is a front view of a bra showing under arm cup hems, upper neck hems and ultra thin tubular fabric casings.

FIG. 21 shows an interface sleeve 154 attached to a wide T-shaped anchor tab 150. The interface sleeve 154 is configured to be retained in place within the ultra thin tubular fabric casing 58. The wide T-shaped anchor tab 150 is retained inside the hem 67 that is formed between the inner underarm cup hem edge 66 and the outer underarm cup hem edge 68, as shown in FIG. 40. The interface sleeve 154 is shown only in outline in FIG. 21, for clarity of illustration.

The disclosed configuration of securing the wide T-shaped anchor tab 150 may be achieved by: (i) a user repairing the bra support ultra thin tubular fabric casing 58, or (ii) a manufacturer when the associated support underwire is emplaced in the bra, both methods securing the end of the support underwire (not shown) from producing wear in the bra. It can be appreciated by one skilled in the art that both the T-shaped anchor tab 140 and the wide T-shaped anchor tab 150 can also be adapted for use with any of the interface sleeves disclosed herein.

Figure 22:
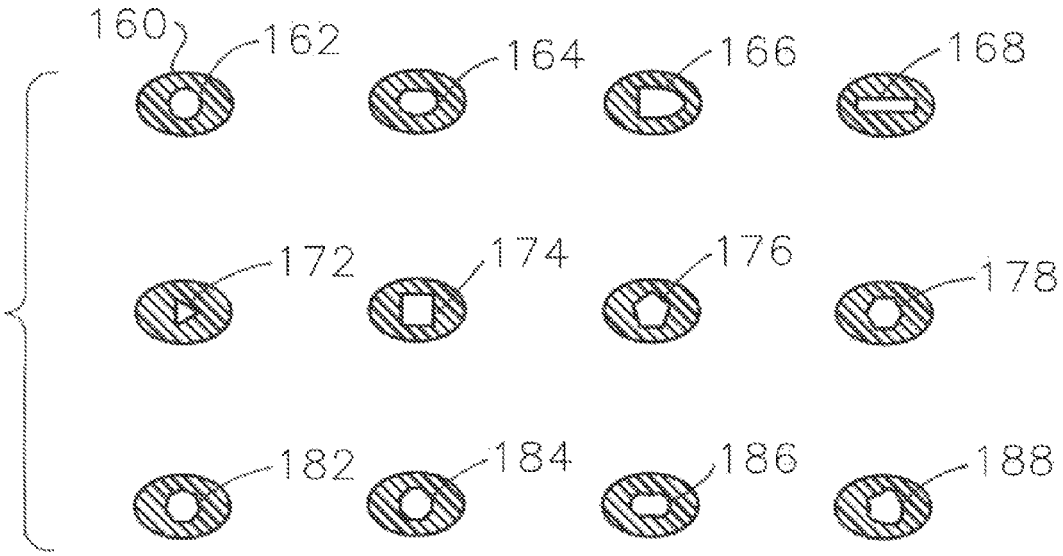
FIG. 22 is an array of wear-reducing anchor point bodies having elliptical cross sectional shapes, each wear-reducing anchor point body with a different support underwire cavity cross-sectional shape.

As described above, the underwire cavity provided inside the interface sleeve can have any shape desired by the designer of the wear-reducing anchor point body. As shown in FIG. 22, a wear-reducing anchor point body 160 having an elliptical cross sectional shape, may enclose an underwire cavity having a circular shape 162, a kidney shape 164, a bullet shape 166, a narrow rectangular shape 168, a triangular shape 172, a square shape 174, a pentagonal shape 176, a hexagonal shape 178, a heptagonal shape 182, a hexagonal shape 184, a bi-spherical shape 186, or an irregular shape 188.

Figure 23:
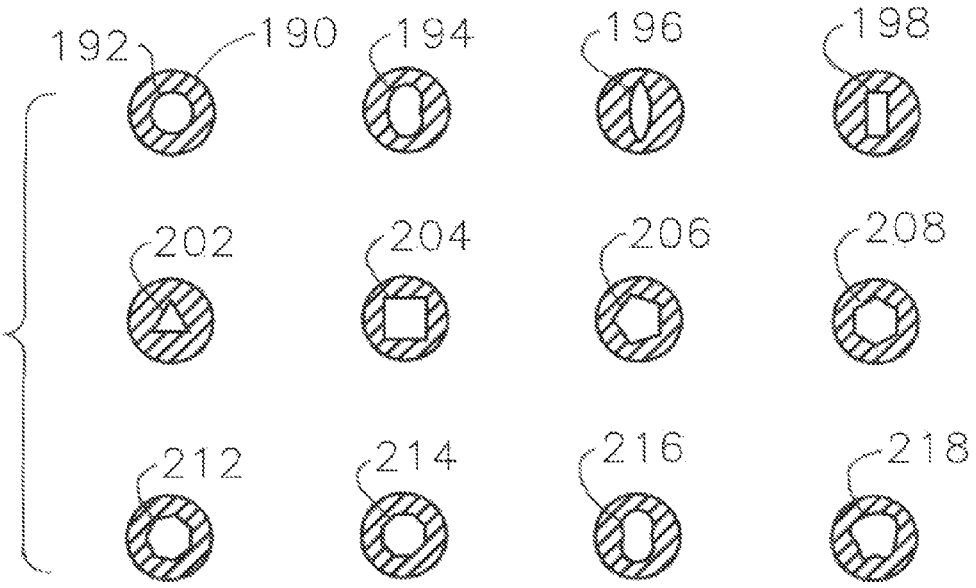
FIG. 23 is an array of wear-reducing anchor point bodies having round cross sectional shapes, each wear-reducing anchor point body with a different support underwire cavity cross-sectional shape.

Similarly, a wear-reducing anchor point body having a round cross-sectional shape 190, as shown in FIG. 23, may enclose an underwire cavity having a circular shape 192, a kidney shape 194, a bullet shape 196, a narrow rectangular shape 198, a triangular shape 202, a square shape 204, a pentagonal shape 206, a hexagonal shape 208, a heptagonal shape 212, a hexagonal shape 214, a bi-spherical shape 216, or an irregular shape 218.

Figure 24:
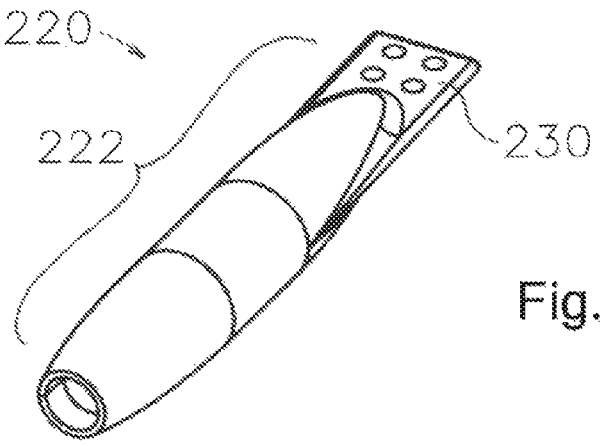
FIG. 24 is an arcuate interface sleeve with an anchor tab attached to a proximal paraboloid section, in accordance with the present invention.
Figure 25:
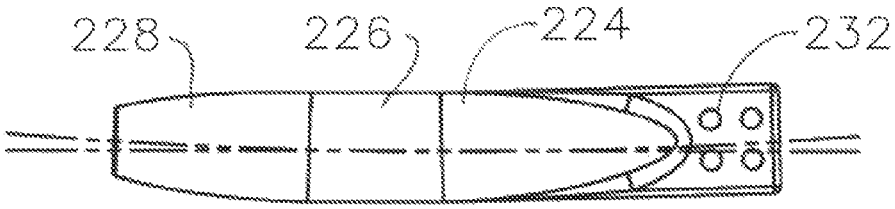
FIG. 25 is a top view of the arcuate interface sleeve of FIG. 24 featuring a curved axis, a design used to more easily accommodate a arcuate underwire within a arcuate ultra thin tubular fabric casing, and provide enhanced friction reduction.

In an exemplary embodiment, a WRAP device may be configured as an arcuate wear-reducing anchor point body 220 that includes an arcuate interface sleeve 222 with an attached anchor tab 230, shown in FIG. 24. As best shown in FIG. 25, the arcuate interface sleeve 222 of FIG. 24, comprises a proximal paraboloid section 224, a cylindrical section 226, and a distal paraboloid section 228, with the anchor tab 232 preferably attached to the proximal paraboloid section 224. In the configuration shown, the anchor tab 230 includes four through-holes 232 arranged in the pattern of a square.

Figure 26:
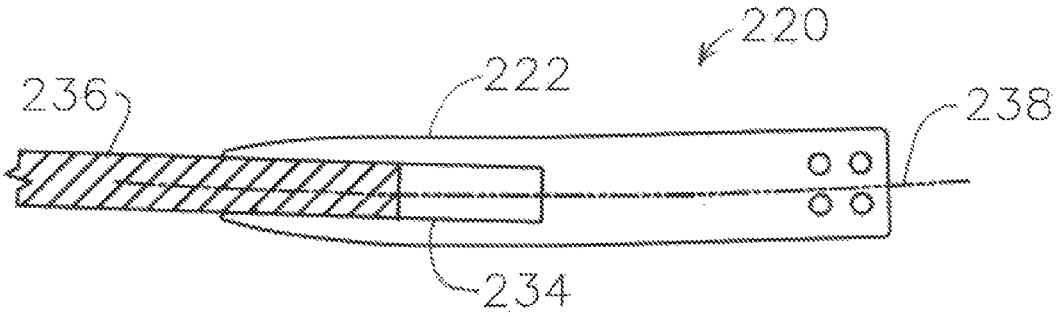
FIG. 26 is a sectional top view of the arcuate interface sleeve of FIG. 24 showing insertion of a support underwire in an underwire cavity.

The arcuate interface sleeve 222 includes an arcuate underwire cavity 234, wherein the interface sleeve 222 and the arcuate underwire cavity 234 both generally conform to the curvature of a arcuate axis 238 so as to optimally accommodate a arcuate support underwire 236, as shown seen in FIG. 26, which is a top sectional view of the arcuate wear-reducing anchor point body 220. The arcuate support underwire 236 generally follows the contour of the arcuate axis 238.

Figure 27:
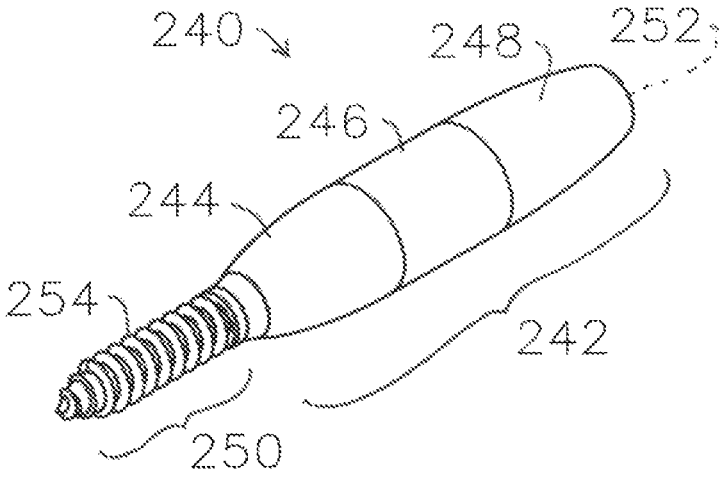
FIG. 27 is an wear-reducing anchor point body comprising an interface sleeve with a threaded anchor, in accordance with the present invention.

A wear-reducing anchor point interface sleeve can also be anchored in place by using a threaded portion to engage material used in the ultra thin tubular fabric casing. There is shown in FIG. 27 a threaded anchor point body 240 comprising an interface sleeve 242 with a threaded anchor 250, in accordance with an aspect of the present invention. The interface sleeve 242 includes a proximal paraboloid section 244, a cylindrical section 246, and a distal paraboloid section 248, with the threaded anchor 250 attached to the proximal paraboloid section 244. An underwire cavity 252, not shown for clarity of illustration, extends into the proximal paraboloid section 248, in a manner similar to the underwire cavities described above. In the example shown, the threaded anchor 250 may include a coarse thread 254 to engage the bra fabric.

Figure 28:
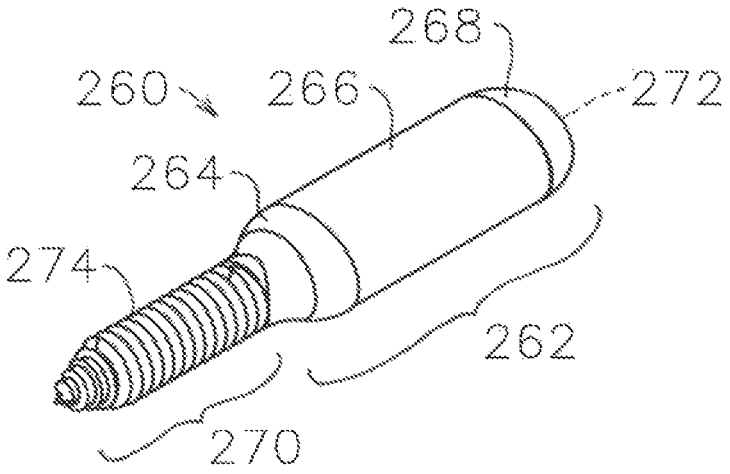
FIG. 28 is an wear-reducing anchor point body comprising an interface sleeve with a ribbed anchor, in accordance with the present invention.

FIG. 28 shows a ribbed anchor point body 260 comprising an interface sleeve 262 having a ribbed anchor 270 with circumferential ridges 274, in accordance with another aspect of the present invention. The interface sleeve 262 includes a proximal paraboloid section 264, a cylindrical section 266, and a distal paraboloid section 268, with the ribbed anchor 270 attached to the proximal paraboloid section 264. An underwire cavity 272 (not seen) extends through the distal paraboloid section 268 and into the cylindrical section 266.

Figure 29:
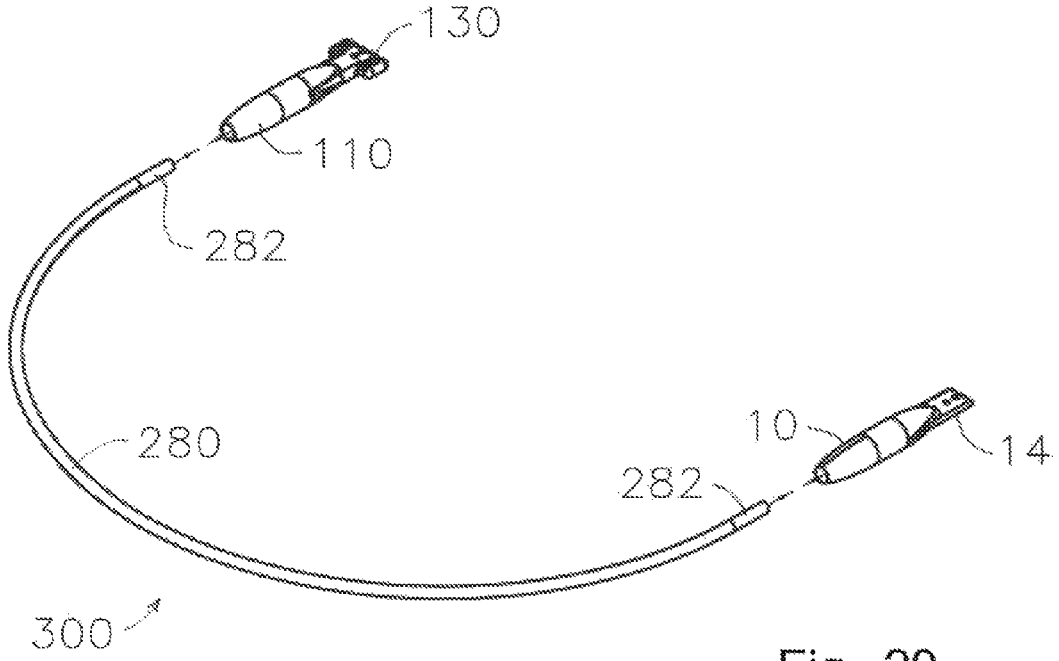
FIG. 29 is an underwire assembly with a bra support underwire, the wear-reducing anchor point body of FIG. 1, and the T-tab anchor point body of FIG. 13, in accordance with the present invention.

In yet another exemplary embodiment, a manufacturer can provide one or two wear-reducing anchor point bodies with a support underwire for installation into a bra product. As shown in FIG. 29, an underwire assembly 300 comprises a bra underwire 280, the wear-reducing anchor point body 10, and the T-tab wear-reducing anchor point body 110. It should be understood that any combination of wear-reducing anchor point bodies can be used on the bra underwire 280. The bra underwire 280 may exhibit limited movement within the wear-reducing anchor point body 10 and/or within the T-tab anchor point body 110 during normal wear. In either case, the anchor tab 14 retains the wear-reducing anchor point body 10 in the ultra thin tubular fabric casing (not shown), and the anchor tab 130 retains the wear-reducing anchor point body 110 in the ultra thin tubular fabric casing 58 (not shown), after the anchor tab 14 and the anchor tab 130 have been affixed to the bra 410 (not shown).

Alternatively, an adhesive layer 282 may be applied to one end of the bra support underwire 280 to secure the wear-reducing anchor point body 10, and/or applied to the other end of the bra support underwire 280 to secure the T-tab wear-reducing anchor point body 110 in place. It should be understood that any one of the wear-reducing anchor point body 40, shown in FIG. 7, the arcuate wear-reducing anchor point body 80, shown in FIG. 11, the T-tab wear-reducing anchor point body 110, shown in FIG. 13, the arcuate wear-reducing anchor point body 220, shown in FIG. 24, the threaded anchor point body 240, shown in FIG. 27, and the ribbed anchor point body 260, shown in FIG. 28, can be substituted for the wear-reducing anchor point body 10. It should also be understood that any one of the wear-reducing anchor point body 10, the wear-reducing anchor point body 40, shown in FIG. 7, the arcuate wear-reducing anchor point body 80, shown in FIG. 11, the arcuate wear-reducing anchor point body 220, shown in FIG. 24, the threaded anchor point body 240, shown in FIG. 27, and the ribbed anchor point body 260, shown in FIG. 28, can be substituted for the T-tab wear-reducing anchor point body 110.

Figure 30:
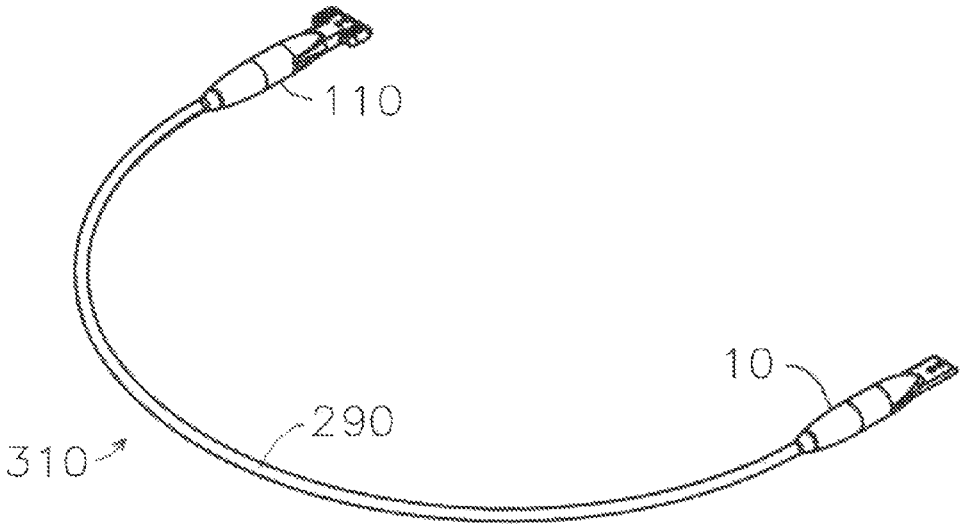
FIG. 30 is a unitary support underwire assembly with a bra underwire, the wear-reducing anchor point body of FIG. 1, and the T-tab wear-reducing anchor point body of FIG. 13

In still another embodiment, shown in FIG. 30, an underwire assembly 310 comprises one or both of the wear-reducing anchor point body 10 and the T-tab wear-reducing anchor point body 110 forming a unitary assembly with an underwire 290. It can be appreciated by one skilled in the art that: (i) any one of the wear-reducing anchor point bodies 50, the arcuate wear-reducing anchor point body 80, the T-tab wear-reducing anchor point body 110, the arcuate wear-reducing anchor point body 220, the wear-reducing threaded anchor point body 240, and the wear-reducing threaded anchor point body 260 can be substituted for the wear-reducing anchor point body 10; and (ii) any one of the wear-reducing anchor point body 10, the wear-reducing anchor point body 42, the arcuate wear-reducing anchor point body 80, the arcuate wear-reducing anchor point body 220, the threaded wear-reducing anchor point body 240, and the threaded wear-reducing anchor point body 260 can be substituted for the T-tab wear-reducing anchor point body 110.

Figure 31:
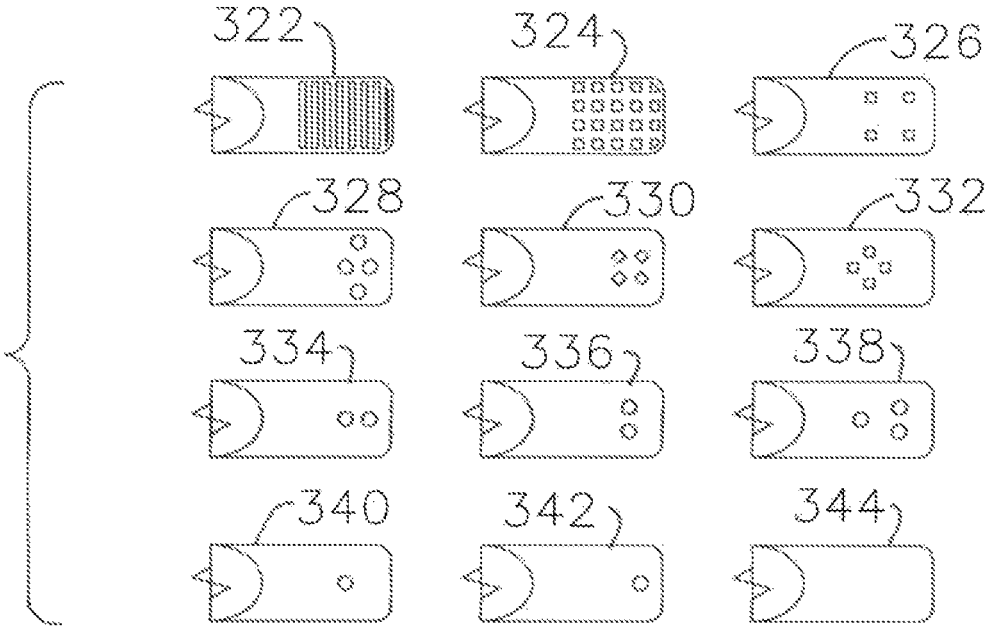
FIG. 31 is an array of designs suitable for use with the wear-reducing anchor point tabs of FIGS. 1, 11, and 24.

It can also be appreciated that any one of the interface sleeves 12, 42, 82, 120, 222, 242, and 262) disclosed above can be attached to any one of the anchor tabs of different configurations shown in FIG. 31. For example, any one of the anchor tab 14, the mesh anchor tab 50, and the side-mounted wear-reducing anchor tab 92 can be replaced by a multiple-slot anchor tab 322, a multiple-hole anchor tab 324, a four-hole anchor tab 326, a four-hole anchor tab 328, a four-hole anchor tab 330, a four-hole anchor tab 332, a two-hole anchor tab 334, a two-hole anchor tab 336, a three-hole anchor tab 338, a single-hole anchor tab 340, a single-hole anchor tab 342, and a solid anchor tab 344.

Figure 32:
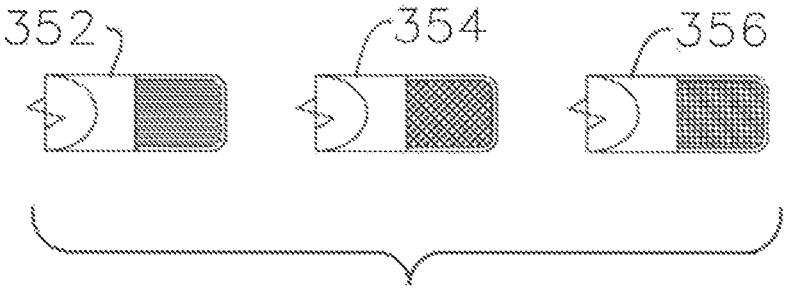
FIG. 32 is a series of designs suitable for use with the wear-reducing anchor point support tab of FIG. 5.
Figure 33:
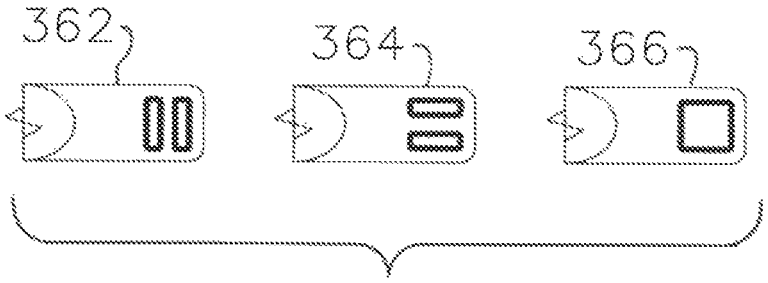
FIG. 33 is a series of designs suitable for use with the wear-reducing anchor point anchor tabs of FIGS. 1, 11, and 24.

Alternatively, any one of the anchor tab 14, the mesh anchor tab 50, and the side-mounted arcuate anchor tab 92 can be replaced by a narrow-slot mesh anchor tab 352, a diagonal-mesh anchor tab 354, or a rectangular-mesh anchor tab 356, shown in FIG. 32. Alternatively, any one of the anchor tab 14, the mesh anchor tab 50, and the side-mounted anchor tab 92 can be replaced by a wide slot anchor tab 362, a wide slot anchor tab 364, or a single-opening anchor tab 366.

Figure 34:
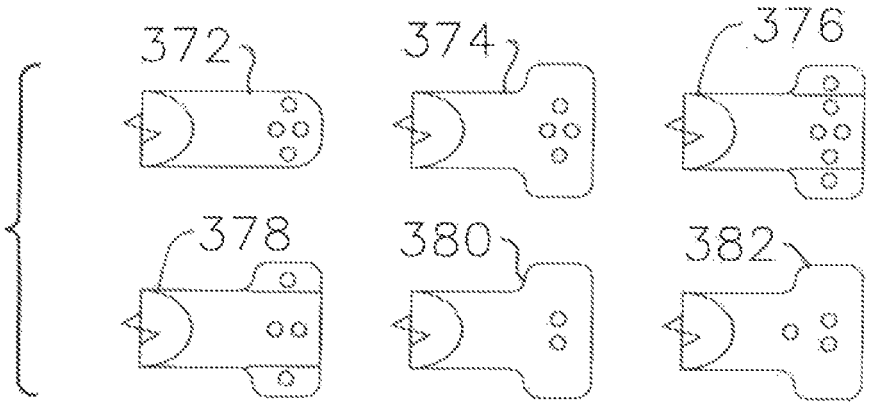
FIG. 34 is a series of designs suitable for use with the wear-reducing anchor point anchor tab of FIG. 13.
Figure 35:
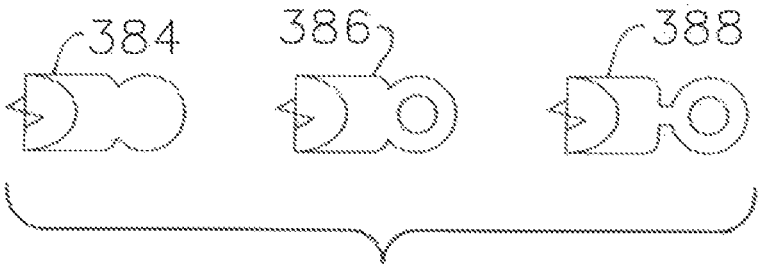
FIG. 35 is a series of designs suitable for use with the wear-reducing anchor point anchor tabs of FIGS. 1, 11, and 24.

There are shown in FIG. 34 a four-hole straight anchor tab 372, a four-hole T-anchor tab 374, a six-hole stepped T-anchor tab 376, a four-hole stepped T-anchor tab 378, a two-hole T-anchor tab 380, and a three-hole T-anchor tab 382, any one of which can be used to replace the T-shaped anchor tab 130 of the T-tab anchor point body 110 shown in FIG. 13. Alternatively, the T-shaped anchor tab 130 can be replaced by any one of a circular anchor tab 384, an open circular anchor tab 386, or an annular anchor tab 388, shown in FIG. 35.

Figure 36:
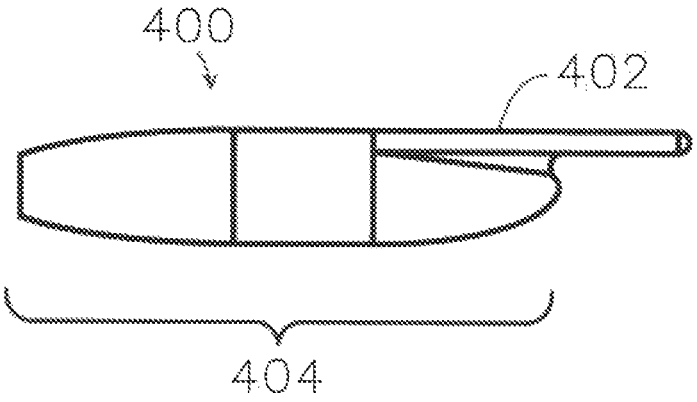
FIG. 36 is a side view of wear-reducing anchor point body having an interface sleeve with an offset anchor tab, in accordance with the present invention.
Figure 37:
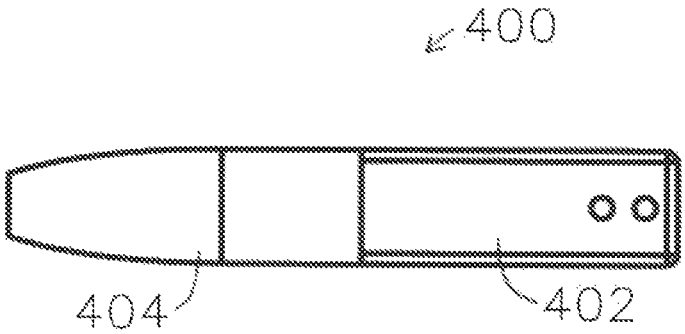
FIG. 37 is a top view of the wear-reducing anchor point body of FIG. 36.
Figure 38:
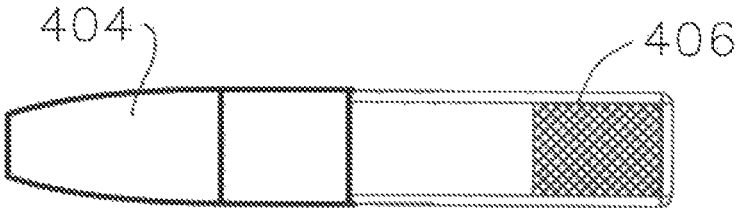
FIG. 38 is a view of the interface sleeve of FIG. 36 with an offset mesh anchor tab.
Figure 39:
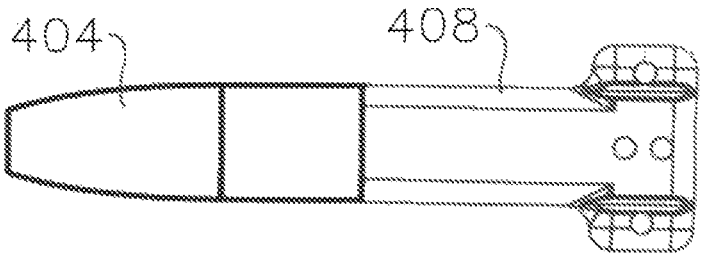
FIG. 39 is a top view of the interface sleeve of FIG. 36 with an offset T-shaped anchor tab.

As shown in FIGS. 36 and 37, a wear-reducing anchor point body 400 may include an interface sleeve 404 with an offset anchor tab 402. It should be understood that the interface sleeve 404 may be used with a mesh anchor tab 406, as shown in FIG. 38, or a T-shaped anchor tab 408, as shown in FIG. 39.

FIG. 40 shows a conventional bra 410 illustrating the arcuate ultra thin tubular fabric casing 58 that may include the underwire assembly 230 of FIG. 26, the underwire assembly 300 of FIG. 29, or the underwire assembly 310 of FIG. 30. The region between the cups is normally designated as a bridge 412. A cup neck hem 414 may extend between cup apexes 416.

FIG. 41 is an isometric diagrammatical view of a reinforced thread wear-reducing anchor point body 420 having an interface sleeve 422 with an attached anchor tab configured as a reinforced thread anchor 418 for anchoring the reinforced thread wear-reducing anchor point body 420. The interface sleeve 422 includes a distal paraboloid section 428, a cylindrical section 426 and a proximal paraboloid section 424, similar to the interface sleeves described above. The reinforced thread anchor 418, or an anchor tab, (as described above) may be attached to the proximal paraboloid section 424 with epoxy, for example; the reinforced thread anchor 418 may be positioned within the interface sleeve during manufacture, and secured to form a one-piece unit.

The reinforced thread wear-reducing anchor point body 420 may be particularly suitable for placement within a ultra thin tubular fabric casing, such as, for example, within the ultra thin tubular fabric casing 58 shown in FIGS. 6 and 21, or the ultra thin tubular fabric casing 76 of FIG. 11. Preferably, the reinforced thread material forming the reinforced thread anchor 418 has a high tensile strength and may comprise of, for example, a nylon-reinforcement or a Kevlar-reinforcement. The configuration of the reinforced thread wear-reducing anchor point body 420, provides a convenient configuration for applications in which anchoring is provided by attachment of the reinforced thread anchor 418 into the ultra thin tubular fabric casing 58, under arm 67, cup neck hem 414, through the inner hem 66, sewn to the hem 67 as an anchor point, the reinforced thread anchor 418, the ultra thin tubular fabric casing 58 or other location on the bra 410 as a manufacturer may desire.

As shown in FIG. 42, the rear cross-sectional profile of the reinforced thread wear-reducing anchor point body 420 may be oval, elliptical, or any other smooth shape. As shown in FIG. 43 the distal paraboloid section 428 is substantially thinner and blunt so as to more easily fit into the ultra thin tubular fabric casing 58. The anchor reinforced thread 418 may be positioned near the tip of the proximal paraboloid section 434, as shown in FIG. 43. In an alternative embodiment, a reinforced thread wear-reducing anchor point body 430 may have a slightly tapered cylindrical section 436 (compared to the cylindrical section 426) attached at one end to the distal paraboloid section 428, and attached at the other end to a slightly smaller proximal paraboloid section 434 (compared to the paraboloid section 424), as shown in FIG. 43. The reinforced thread anchor 418 is attached to the proximal paraboloid section 434.

Figure 44:
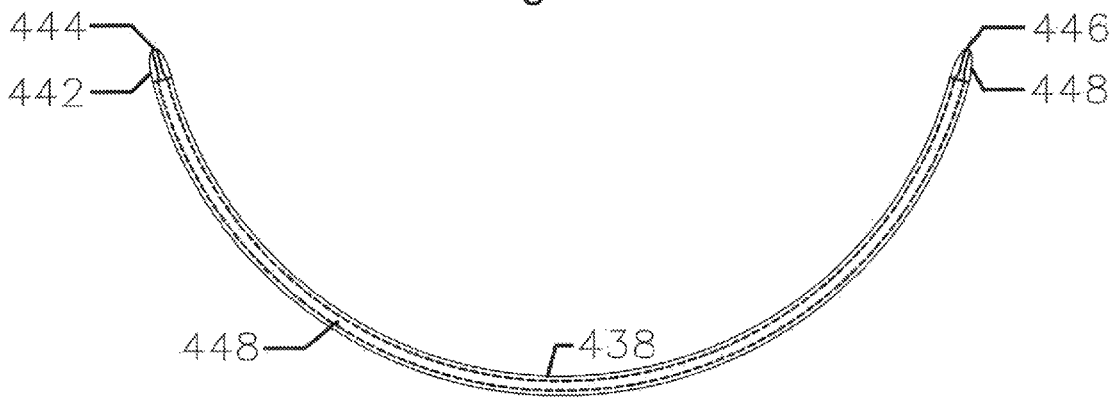
FIG. 44 is a cross sectional profile of a arcuate Tubular wear-reducing anchor point body.

FIG. 44 shows a cross-sectional profile of the tubular wear-reducing anchor point body 438. The wear-reducing interface body 438 may be oval, elliptical, or any other smooth shape, constructed of a wear-reducing material that shall provide a low kinetic friction coefficient, the tubular wear-reducing anchor point body 438 may be constructed using a molded, extrusion process or other process utilizing a low friction coefficient materials such as Nylon, a polymer mix material, carbon fiber, metal, or synthetic materials that would provide a low friction coefficient as the manufacturer may desire to use. The tubular wear-reducing anchor point body 438 has a distal paraboloid end 442. At the apex of the distal paraboloid 442 is a circular distal aperture 444. As shown, the tubular wear-reducing anchor point body 438 has a proximal paraboloid end 448. As shown, the proximal paraboloid 440 end has at the apex a circular proximal aperture 446 matching in size and shape to the circular distal aperture 444.

Figure 45:
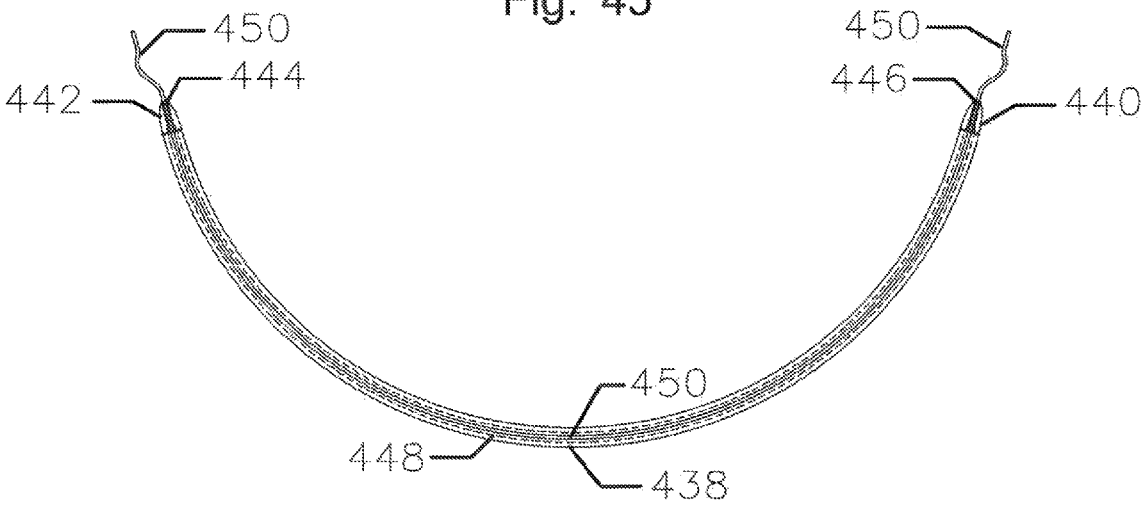
FIG. 45 is an isometric diagrammatical view of a arcuate Tubular reinforced thread wear-reducing anchor point body.

FIG. 45 provides an isometric diagrammatical view of a tubular reinforced threaded wear-reducing anchor point body 438. As shown, the entirety of the tubular reinforced threaded wear-reducing anchor point body 438 is constructed of a low friction coefficient polymer such as Nylon, polymer mix material or synthetic materials as would be known to those skilled in the art. The tubular reinforced threaded wear-reducing anchor point body 438 is a wear-reducing anchor point interface sleeve with a low kinetic and static coefficient friction for use within the ultra thin tubular fabric casing 58, 76. As shown, the tubular reinforced thread wear-reducing anchor point body 438 has a continuously smooth interior cavity 448. As shown, the interior tubular cavity 448 connects both the circular distal apex aperture 444 and the circular proximal apex aperture 446. The continuously smooth interior of the interior tubular cavity 448, allows for the installation of the reinforced thread anchor 418, 450, the reinforced thread anchor 418, 450, has a Nylon or Kevlar type component thereby reinforcing the thread 418, 450 with a much greater tensile strength than that of conventionally used sewing threads. The reinforced thread anchor 418, 450 with the enhancement of a Nylon or Kevlar type component having a tensile strength much greater than that of standard thread, the reinforced thread anchor 418, 450 can be passed through the wear-reducing circular distal apex aperture 444, the reinforced thread anchor 418, 450 may then continue within the tubular cavity 448 until exiting the circular proximal apex aperture 446. With the reinforced thread anchor 418, 450 extended through the circular distal apex aperture 444, and the wear-reducing circular proximal apex aperture 446, the reinforced thread anchor 418, 450 can then be utilized for anchoring the reinforced thread anchor 418, 450 to either the ultra thin tubular fabric casing 58, 452, or to the under arm hem 67, and/or to the cup upper hem 414, when the reinforced thread anchor 418, 450 is attached, to the ultra thin tubular fabric casing 58 or anchored to the under arm hem 67, and/or to upper hem 414 the reinforced thread anchor 418, 450 secures the tubular reinforced threaded wear-reducing anchor point body 438 in place. Once the tubular reinforced threaded anchor point body 438 is anchored in place by the reinforced thread 418, 450, the tubular threaded anchor point body 438 cannot dislodge from the ultra thin tubular fabric casing 58 and cause discomfort or pain to the wearer of the bra 410.

Figure 46:
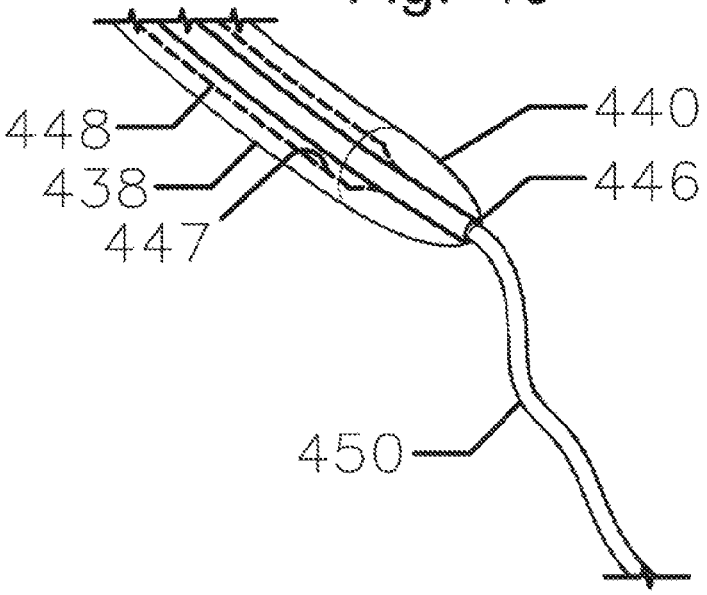
FIG. 46 is a cross-sectional profile of the Tubular reinforced thread wear-reducing anchor point body.

FIG. 46 provides a cross sectional-profile of the tubular reinforced thread wear-reducing anchor point body 438. The tubular reinforced thread wear-reducing anchor point body 438 may be round, oval, elliptical, or any other low kinetic and static coefficient reducing shape the manufacturer may desire to use. Shown is the proximal paraboloid 440. Also shown is the circular proximal apex aperture 446, and the reinforced thread anchor 418, 450. Also shown is the smooth interior wall 447 of the interior tubular cavity 446.

Figure 47:
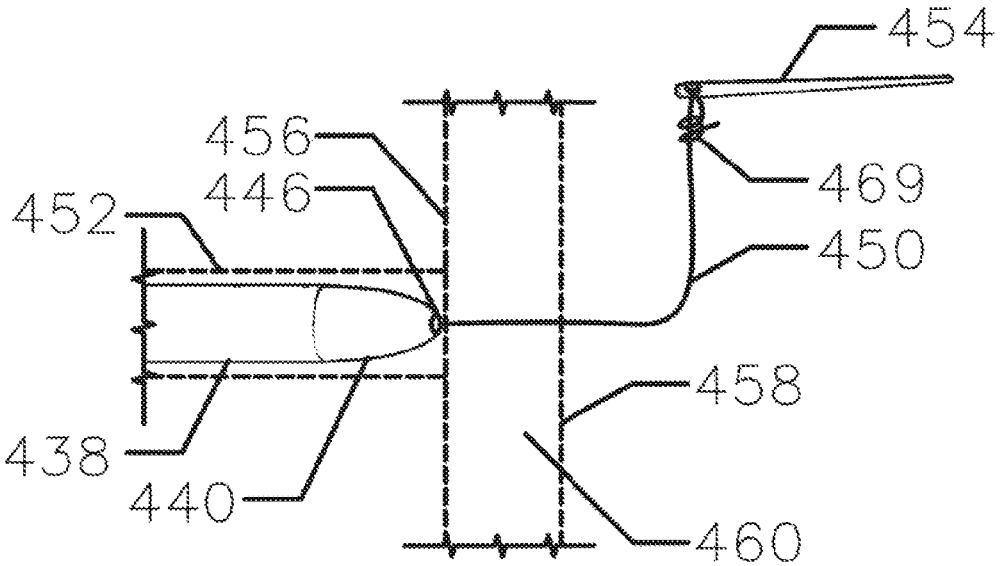
FIG. 47 is a cross-sectional profile of the Tubular reinforced thread wear-reducing anchor point body within the ultra thin tubular fabric casing, with intersecting hem.

FIG. 47 shows a tubular reinforced thread anchor point body 438, retained within the ultra thin tubular fabric casing 452. The tubular reinforced thread anchor point body 438, contains a reinforced thread anchor 418, 450, which can be attached to the bra 410, under arm hem 460, and to the upper cup hem 414, using a manual sewing needle 454, shown, or a sewing machine needle (not shown for clarity). The reinforced thread anchor 418, 450, pierces through the interior under arm hem wall 456, and through the under arm hem body 460, and to upper hem 414, anchoring the tubular reinforced thread wear-reducing anchor point body 438, with the reinforced thread anchor 418, 450 to the hem material 460, and/or to upper cup hem 414. The stress of use by the wearer of the bra 410 on the ultra thin tubular fabric casing 452 is greatly transferred to the tubular reinforced thread wear-reducing anchor point body 438438 and the under arm hem 460, and to upper hem 414, thus greatly reducing wear. A standard abrasive bra underwire (not shown) which will through normal use completely pierce through the ultra thin tubular fabric casing 452, the tubular reinforced thread wear-reducing anchor point body 438, cannot completely pierce through the ultra thin tubular fabric casing 58, 452 and harm the wearer of the bra 410, as it is now transversely anchored to the bra 410, under arm hem 67, 460, and to upper cup hem 414. The use of the tubular reinforced thread wear-reducing anchor point body 438, along with the use of the reinforced thread anchor 418, 450, allows for concealed superior lift and superior support as the sag of an unsupported yet abrasive standard underwire (not shown) is now addressed, as an unanchored abrasive standard steel underwire from the time of insertion begins to promote premature wear of the ultra thin tubular fabric casing due to constant kinetic stresses on the ultra thin tubular fabric casing 58, 452 of the bra 410.

Figure 48:
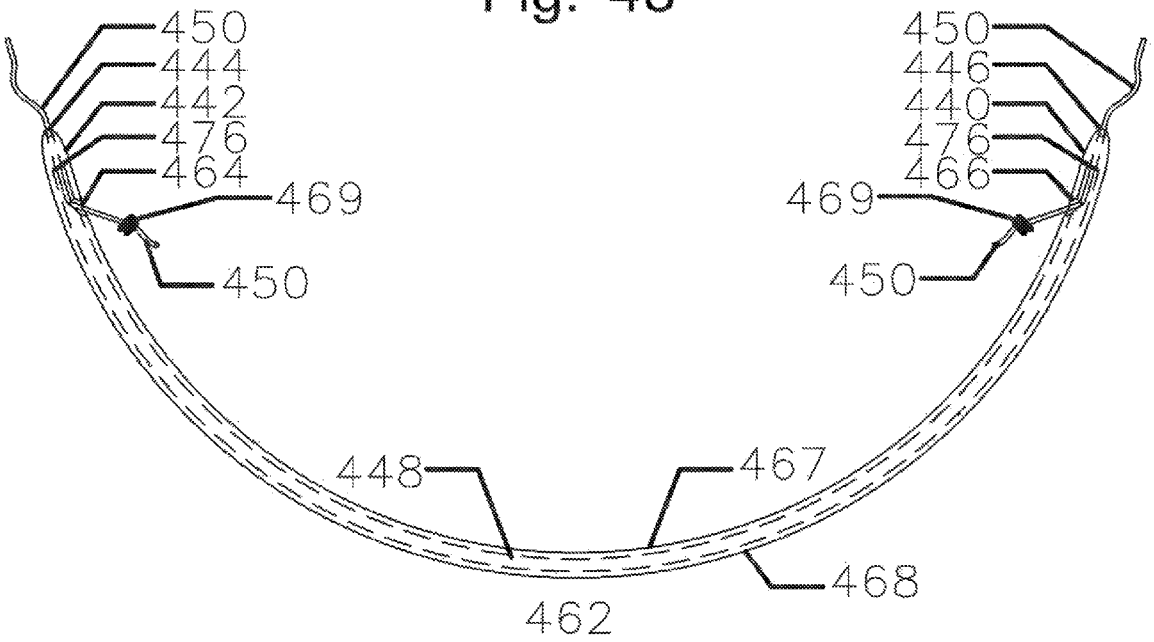
FIG. 48 is an isometric diagrammatical view of a arcuate Tubular reinforced thread wear-reducing anchor point body, showing the distal apex aperture, distal access aperture, proximal access aperture and proximal apex aperture, distal reinforced thread anchor, proximal reinforced thread anchor.

FIG. 48 shows the tubular reinforced threaded wear-reducing anchor point body 462. The tubular reinforced threaded wear-reducing anchor point body 462 has an upper curvature 467, running from the distal end to proximal end. As shown, the tubular reinforced threaded wear-reducing anchor point body 462 has a lower curvature 468, running from the distal end to proximal end. Also shown is the distal paraboloid 442, and at the apex of the distal paraboloid 442 is the circular distal paraboloid apex aperture 444. The tubular reinforced threaded wear-reducing anchor point body 462 has a top curvature 467 and a distal access aperture 464. Also shown is a proximal paraboloid end 440, and at the apex of the proximal paraboloid 440, is the proximal paraboloid circular apex aperture 446. The distal paraboloid access aperture 464 intersects within the interior tubular cavity 448, the interior tubular cavity 448 connects the distal paraboloid circular apex aperture 444 to the proximal circular paraboloid apex aperture 446. Also shown is the reinforced thread 450, which has a reinforced thread knot 469. The reinforced thread 450 may be fed through the distal access aperture 464 into the interior tubular cavity 448, continuing therethrough to the circular distal paraboloid apex aperture 444. The reinforced thread 450 with the reinforced thread knot 469 is pulled through the distal paraboloid access aperture 464. The reinforced thread knot 469, being larger than the circular distal paraboloid apex aperture 464. The reinforced thread 450 then passes through the distal end paraboloid access aperture 464, and the reinforced thread knot 469, then rests behind the smaller circular distal end paraboloid apex aperture wall 476, holding the reinforced thread knot 469 in place while the reinforced thread 450 is anchored to the bra 410, under arm hem 460. Also shown is the proximal paraboloid access aperture 466, which intersects within the tubular reinforced threaded wear-reducing anchor point body 462, interior tubular cavity 448. The interior tubular cavity 448 connects the proximal paraboloid circular apex aperture 446 to the circular distal paraboloid apex aperture 444. Also shown is the reinforced thread 450 and the reinforced thread knot 469. The reinforced thread 418, 450 may be passed therethrough the proximal access aperture 466 into the interior tubular cavity 448, then continue therethrough to the proximal circular paraboloid apex aperture 446, then the reinforced thread 418, 450 exiting the circular proximal paraboloid apex aperture 446. The reinforced thread 418, 450, with the reinforced threaded knot 469 is pulled therethrough the distal paraboloid access aperture 464, the reinforced thread knot 469, being smaller than the distal paraboloid access aperture 464, will then pass therethrough the distal paraboloid access aperture 464, and come to rest behind the smaller circular distal paraboloid apex aperture 444 and distal rear wall 476, thus holding the reinforced thread 450, and the reinforced thread knot 469, in place until the reinforced thread 450, is sewn to the bra 410, under arm hem 67, 460 and upper cup hem 414.

Figure 49:
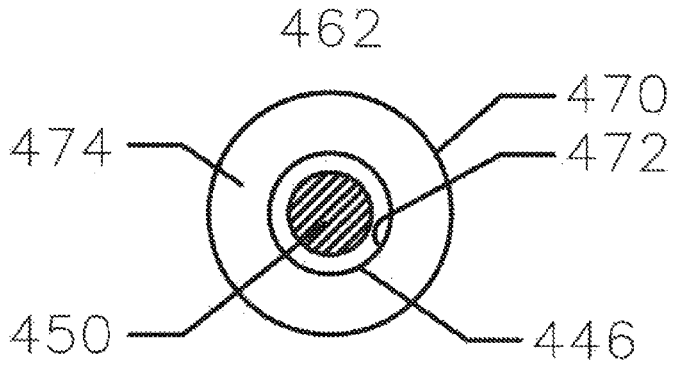
FIG. 49 is a cross section view of the molded or arcuate Tubular reinforced thread wear-reducing anchor point body end.

FIG. 49 provides a cross section view of the molded or extruded tubular reinforced threaded wear-reducing anchor point body end of 462. Shown in this cross-sectional view is a smooth circular exterior wall 470, but it should be noted that the body 462 as shown should not be taken as a limiting factor. The body 462 may be circular, oval or any other low kinetic friction and low static coefficient friction reducing design. Also shown is the circular proximal paraboloid apex aperture 446, the smooth interior surface wall 472, which allows for the exit of the reinforced thread 450 for anchoring to the bra 410, (410 not shown for clarity). Also shown is the interior of the wall material 474, molded or extruded of Nylon, polymer mix material or synthetic material that provides a low kinetic and low static coefficient reducing friction on the thin ultra thin tubular fabric casing 58, 452.

Figure 50:
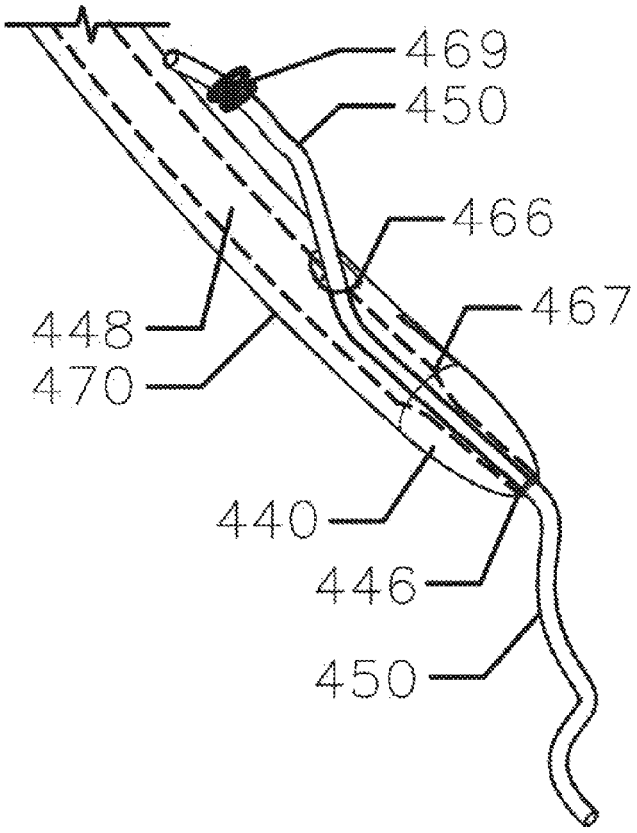
FIG. 50 is an isometric diagrammatical view of the Tubular reinforced thread wear-reducing anchor point body.

FIG. 50 provides an isometric diagrammatical view of the tubular reinforced thread anchor point body 462. For clarity, only the proximal end of the tubular thread anchor point body 462 is shown, as the proximal paraboloid 440, and the distal paraboloid 442 are of the same design and serve the same purpose. Also shown is the proximal paraboloid 440 with a circular apex aperture 446. The circular proximal paraboloid apex aperture 446 as shown is smaller than the proximal access aperture 466. Also shown is the reinforced thread 418, 450 entering from the proximal access aperture 466, with the reinforced thread knot 469. Also shown is the reinforced thread 450, entering the proximal access aperture 466, traveling within the continuous smooth interior tubular section 448 and then exiting therethrough the circular proximal paraboloid apex aperture 446. The reinforced thread 450 is passed therethrough the proximal access aperture 466 and into the interior tubular cavity 448, then the reinforced thread 418, 450 is passed through the smaller circular paraboloid apex aperture 446. The reinforced thread knot 469 being part of the reinforced thread 450, is as a result pulled therethrough the paraboloid access aperture 466. Once the reinforced thread 418, 450 is pulled sufficiently therethrough the circular proximal paraboloid apex aperture 466 the reinforced thread knot 469 will then lodge against the circular proximal paraboloid apex aperture rear wall 467. The reinforced thread knot 469 is then held in place against the rear wall 467 of the circular proximal paraboloid apex aperture 446 as the proximal apex aperture 446 is smaller in diameter than the proximal access aperture 466, the reinforced thread 450, is then sewn to the bra 410, under arm hem 67, 460 and/or upper cup hem 414.

It is also to be understood that the description herein is only exemplary of the invention, and is intended to provide an overview for the understanding of the nature and character of the disclosed wear-reducing anchor point. The accompanying drawings are included to provide a further understanding of various features and embodiments of the method and devices of the WRAP which, together with their description serve to explain the principles and operation of the invention.

Unless defined otherwise, all technical and scientific terms used herein have the meaning commonly understood by a person skilled in the art to which this invention belongs.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the present specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

What is claimed is:

1. An anchor point device suitable for use with a bra support underwire, said device comprising:

an interface sleeve having a continuously smooth outer surface, said interface sleeve further having an enclosed underwire cavity sized and shaped to accommodate an end of the bra support underwire; and an anchor tab attached to said interface sleeve;

wherein said interface sleeve comprises:

a distal paraboloid section having said underwire cavity extending into said distal paraboloid section;

a cylindrical section attached to said distal paraboloid section, said cylindrical section having said underwire cavity terminating therein; and a proximal paraboloid section attached to said cylindrical section.

2. The device of claim 1 wherein said interface sleeve comprises a material selected from the group consisting of a polymer, a rubber, a silicone, and a combination of polymer, rubber, and silicone.

3. The device of claim 1 wherein said anchor tab comprises a material selected from the group consisting of a fabric material, a polymer, a reinforced thread, a perforated polymer, a rubber, a silicone, and a combination of polymer, rubber, silicone, and reinforced thread.

4. The device of claim 1 wherein said distal paraboloid section, said cylindrical section, and said proximal paraboloid section form a unitary component.

5. The device of claim 1 wherein said anchor tab, said distal paraboloid section, said cylindrical section, and said proximal paraboloid section form a unitary component.

6. The device of claim 1 wherein said anchor tab is attached to said interface sleeve by one of molding, frequency welding, with mechanical fasteners, or by chemical means.

7. The device of claim 1 wherein at least one of said distal paraboloid section, said cylindrical section, and said proximal paraboloid section comprises one of a circular cross sectional shape, an elliptical cross sectional shape, and a smooth curved cross sectional shape.

8. The device of claim 1 wherein said anchor tab is attached to at least one of said cylindrical section and said proximal paraboloid section such that the surface of said device comprises a smooth transition from a surface of said anchor tab to a surface of at least one of said cylindrical section(s) and said proximal paraboloid section.

9. The device of claim 1 wherein said interface sleeve comprises an arcuate shape.

10. The device of claim 1 wherein said anchor tab comprises one of a threaded section, a ribbed section, or an anchor thread.

11. The device of claim 1 wherein said anchor tab comprises a solid geometric shape having rounded edges and rounded corners.

12. The device of claim 1 wherein said anchor tab comprises a reinforced thread anchor for sewing into an underwire cavity enclosure, bra hem or bra body.

13. An anchor point device suitable for use with a bra support underwire, said device comprising:

a unitary interface sleeve; and an anchor tab attached to said interface sleeve;

wherein the unitary interface sleeve comprises:

a distal paraboloid section with an underwire cavity passing therethrough;

a cylindrical section extending from said distal paraboloid section, said cylindrical section having said underwire cavity terminating therein; and a proximal paraboloid section extending from said cylindrical section.

14. The device of claim 13 wherein at least one of said distal paraboloid section, said cylindrical section, and said proximal paraboloid section comprises a shape selected from the group consisting of a circular cross sectional shape, an elliptical cross sectional shape, and a smooth curved cross sectional shape.

15. The device of claim 13 wherein said anchor tab is attached to at least one of said cylindrical section and said proximal paraboloid section such that the surface of said device comprises a smooth transition from a surface of said anchor tab to a surface of at least one of said cylindrical section and said proximal paraboloid section.

16. An underwire assembly suitable for use as a bra support, said assembly comprising:

a support underwire;

a first unitary interface sleeve emplaced on a first end of said support underwire, said first unitary interface sleeve comprising a first distal paraboloid section with a first underwire cavity passing therethrough;

a first cylindrical section extending from said first distal paraboloid section, said first cylindrical section having said first underwire cavity terminating therein;

a first proximal paraboloid section extending from said first cylindrical section; and an anchor tab attached to said interface sleeve.

17. The underwire assembly of claim 16 further comprising:

a second unitary interface sleeve emplaced on a second end of said support underwire, said second unitary interface sleeve comprising a second distal paraboloid section with a second underwire cavity passing therethrough;

a second cylindrical section extending from said second distal paraboloid section, said second cylindrical section having said second underwire cavity terminating therein; and a second proximal paraboloid section extending from said first cylindrical section.

18. The underwire assembly of claim 16 further comprising a tubular reinforced thread wear-reducing anchor point body and a reinforced thread anchor.

19. An anchor point device suitable for use as a bra support underwire, said device comprising:

a tubular threaded anchor point body comprising an interface body;

a distal paraboloid end comprising a distal paraboloid apex; and a proximal paraboloid end comprising a proximal paraboloid apex; and wherein the distal paraboloid apex comprises a distal paraboloid apex aperture and wherein the proximal paraboloid apex comprises a proximal paraboloid apex aperture matching in size and shape to the distal paraboloid apex aperture.

20. The device of claim 19, wherein the interface body is a shape selected from the group consisting of oval, elliptical, and any other smooth shape.

21. The device of claim 19, wherein the tubular threaded anchor point body and the interface body are constructed of a material with a low kinetic friction coefficient.

22. The device of claim 21, wherein the material with a low kinetic friction coefficient is selected from the group consisting of a polymer, a polymer mix, carbon fiber, and metal.

23. The device of claim 19, wherein the tubular threaded anchor point body comprises an interior tubular cavity, and wherein the interior tubular cavity connects both the distal paraboloid apex aperture and the proximal paraboloid apex aperture.

24. The device of claim 23, wherein the interior tubular cavity is configured to receive a reinforced thread installed through the distal paraboloid apex aperture, continuing within the interior tubular cavity, and exiting the proximal paraboloid apex aperture, and further wherein the reinforced thread anchor comprises a Kevlar type component.

25. The device of claim 24, wherein the reinforced thread anchor is attached to a tubular fabric casing, an underarm hem wall, under arm hem body or cup neck hem, thereby anchoring the tubular threaded anchor point body in place.

26. The device of claim 19, wherein the tubular threaded anchor point body comprises:

an upper curvature running from the distal to proximal end;

a lower curvature running from the distal to proximal end;

the distal paraboloid end comprising the distal paraboloid apex and the distal paraboloid apex aperture; and the proximal paraboloid end comprising the proximal paraboloid apex and the proximal paraboloid apex aperture; and a distal access aperture.

27. The device of claim 26, wherein:

the distal access aperture intersects within the interior tubular cavity and connects the distal paraboloid apex aperture to the proximal paraboloid apex aperture;

the interior tubular cavity is configured to receive a reinforced thread anchor installed through the distal access aperture, continuing within the interior tubular cavity, and exiting the distal paraboloid apex aperture, and wherein the reinforced thread anchor comprises a Kevlar type component, and wherein the reinforced thread anchor comprises a reinforced thread knot smaller than the distal paraboloid apex aperture; and the reinforced thread knot is configured to rest behind a wall of the distal paraboloid apex aperture, thereby holding the reinforced thread knot in place and anchoring the reinforced thread anchor to a bra under arm hem or neck hem.

28. The device of claim 19, wherein the distal paraboloid apex aperture and the proximal paraboloid apex aperture are each circular.

* * * * *